US006853334B2

(12) United States Patent
Imai

(10) Patent No.: US 6,853,334 B2
(45) Date of Patent: Feb. 8, 2005

(54) MULTI-LAYER-SUBSTRATE AND SATELLITE BROADCAST RECEPTION APPARATUS

(75) Inventor: Takao Imai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 50 days.

(21) Appl. No.: 10/409,181

(22) Filed: Apr. 9, 2003

(65) Prior Publication Data

US 2003/0189517 A1 Oct. 9, 2003

(30) Foreign Application Priority Data

Apr. 9, 2002 (JP) ..... 2002-106475
Aug. 29, 2002 (JP) ..... 2002-250270

(51) Int. Cl.[7] ..... H01Q 1/38
(52) U.S. Cl. ..... 343/700 MS; 343/840; 333/26; 333/33
(58) Field of Search ..... 343/700 MS, 786, 343/840, 909; 333/26, 33

(56) References Cited

U.S. PATENT DOCUMENTS 5,517,203 A * 5/1996 Fiedziuszko ..... 343/756
6,111,547 A * 8/2000 Gau et al. ..... 343/786
6,677,911 B2 * 1/2004 Moheb ..... 343/786
2003/0197573 A1 * 10/2003 Kato ..... 333/26

FOREIGN PATENT DOCUMENTS

JP 5-183328 A 7/1993

* cited by examiner

*Primary Examiner*—Tan Ho
(74) *Attorney, Agent, or Firm*—Birch, Stewart, Kolasch & Birch, LLP

(57) ABSTRACT

There can be provided an LNB converter including a multilayer substrate formed of more than two layers, capable of providing adequate transit characteristic for any frequency, and a multilayer substrate. A microstrip line is provided at one surface layer's pattern and a second layer's pattern cooperating with the surface layer's pattern to sandwich a dielectric layer underlying the surface layer's pattern. A probe is inserted from the surface layer's pattern in a direction intersecting a 4-layer substrate and in at least one pattern layer other than the first and second, pattern layers at least a region surrounding a hole having a probe passing therethrough is either a pattern-free region provided by removing a predetermined region surrounding the hole or an isolated region corresponding to a predetermined region surrounding the hole and electrically isolated from an outer region of the pattern layer.

32 Claims, 47 Drawing Sheets

MULTI-LAYER-SUBSTRATE AND SATELLITE BROADCAST RECEPTION APPARATUS

BACKGROUND OF THE INVENTION

1. Field of the Invention

The present invention relates to multi-layer substrates and satellite broadcast reception apparatuses including the multi-layer substrate, and receiving a weak electric wave from a satellite, amplifying the electric wave via a low noise amplifier, converting the wave to an intermediate frequency signal and amplifying it (hereinafter referred to as a low noise block-down (LNB) converter).

2. Description of the Background Art

FIG. 43 is an resolved view of a configuration of an LNB converter 130 for one polarized wave reception, by way of example. A weak signal transmitted from a satellite is received at an electric wave receiving portion 116. The received signal is propagated through a waveguide 113 and received by a probe 120 soldered to a double-sided substrate 110 substantially perpendicularly, and then transmitted to a low noise amplifier. Probe 120 penetrates substrate 110 through a hole 110*a* provided in the substrate for attaching the probe, and received by a hole 111*a* provided in a chassis 111 to receive the probe.

The double-sided substrate 110 ground layer 102 and chassis 111 are arranged to contact each other, as shown in FIG. 44. For a double-sided substrate, a microstrip line is formed between first and second layers 101 and 102 and the second layer 102 serving as a ground layer directly contacts chassis 111. Transit loss can be minimized without limit.

In recent years as satellite broadcast services have been diversified for example into such as multichannel services an LNB converter for example receiving electric waves from a plurality of satellites and in addition having a plurality of signal output terminals for transmission to a tuner has been produced. Such an LNB converter of course has a complicated circuit configuration. Conventionally when it is difficult to form such an LNB converter of a single double-sided substrate two or more double-sided substrates have been used and a joint pin or the like has been used to connect signal and power supply lines between the substrates.

Such an LNB converter, however, has a stereoscopic structure. It is also difficult to reduce in size and weight and produced by a complicated process. One approach to overcome these disadvantages is to use a 4-layer substrate. FIG. 45 is a cross section of a 4-layer substrate incorporated in an LNB converter. In FIG. 45 the 4-layer substrate includes two double-sided substrates bonded together by a bonding dielectric layer 106. A topmost, first layer is provided with signal and power supply lines 101*a*. A second layer 102 which and the first layer 101*a* together sandwich a dielectric layer 105, and a third layer 103 which and the second layer together sandwich a dielectric layer 106 are provided with ground layer. A ground layer for the signal and power supply lines is provided at a fourth layer 104. The fourth layer 104 is electrically connected to chassis 111.

The 4-layer substrate as described above allows reduced size and weight. The substrate can also dispense with a joint pin and the like and thus simplify the production process. However, as shown in FIGS. 46 and 47, grounds 103*a*, 104*a* of the third and fourth layers surrounding hole 110*a* having the probe passing therethrough, overlap, as seen in a plane. Hole 110*a* is surrounded by pattern clearances 103*d*, 104*d* and only throughhole lands 103*b*, 104*b* are isolated from the surrounding ground patterns, and there is not a substantial effect on the overlapping. The third and fourth layers' grounds of course also overlap the second, ground layer, as seen in a plane. As such, the second layer 102 serving as a ground layer in a microstrip line formed of the first layer 101*a* and the second layer 102 is in electrical contact with chassis 111 via the third, ground layer and the fourth layer's ground pattern 104.

As such, using in a portion receiving an electric signal from a waveguide a probe which is a component separate from a circuit board provides increased loss of transit characteristic for a specific reception frequency band, resulting the LNB converter providing unsatisfactory transit characteristic.

SUMMARY OF THE INVENTION

The present invention contemplates an LNB converter including a multi-layer substrate formed of more than two layers and employing a probe served as a component separate from the multi-layer substrate, and also capable of providing adequate transit characteristic for all reception frequencies, and a multi-layer substrate.

The present invention provides a satellite broadcast reception apparatus which is an LNB converter comprising a multilayer substrate provided with a microstrip line and including more than two pattern layers sandwiching a dielectric layer, the apparatus receiving an electric wave signal from an antenna, passing the signal through a waveguide and transmitting the signal via a probe to the microstrip line. The microstrip line is formed at one surface layer's pattern a second layer's pattern cooperating with the surface layer's pattern to sandwich a dielectric layer underlying the surface layer's pattern and the probe is inserted from the surface layer's pattern into a probe hole extending in a direction intersecting the multilayer substrate to pass the probe, and in at least one pattern layer other than the first and second, pattern layers at least a region surrounding the probe hole is one of a pattern free region provided by removing a predetermined region surrounding the probe hole and an isolated region corresponding to a predetermined region surrounding the probe hole and electrically isolated from an outer, surrounding region of the at least one pattern layer.

The present invention in another aspect provides a satellite broadcast reception apparatus comprising a multilayer substrate provided with a microstrip line and including more than two pattern layers sandwiching a dielectric layer, the apparatus receiving an electric wave signal from an antenna, passing the signal through a waveguide and transmitting the signal via a probe to the microstrip line. The microstrip line is formed at one surface layer's pattern a second layer's pattern cooperating with the surface layer's pattern to sandwich a dielectric layer underlying the surface layer's pattern and the probe is inserted from the surface layer's pattern into a probe hole extending in a direction intersecting the multilayer substrate to pass the probe, and in at least one dielectric layer overlying a pattern layer other than the first and second, pattern layers at least a region surrounding the probe hole is a dielectric free region provided by removing a predetermined region surrounding the probe hole.

The present invention in still another aspect provides a satellite broadcast reception apparatus comprising a multilayer substrate provided with a microstrip line and including four, microstrip's pattern layers sandwiching a dielectric layer, the apparatus receiving an electric wave signal from an antenna, passing the signal through a waveguide and transmitting the signal via a probe to the microstrip line. The microstrip line is formed at one surface layer's pattern a second layer's pattern cooperating with the surface layer's pattern to sandwich a dielectric layer underlying the surface layer's pattern and the probe is inserted from the surface layer's pattern into a probe hole extending in a direction intersecting the multilayer substrate to pass the probe, and at least one of the third and fourth layer has a pattern with a ground pattern surrounding the probe and isolated by an inner isolation band corresponding to a pattern free portion in a band surrounding a throughhole land passing the probe and by an outer isolation band corresponding to a pattern free portion in a band located outer than the inner isolation band and surrounding the ground pattern, the isolated ground pattern having conduction with respect to another layer through a throughhole extending through the ground pattern for conduction.

When the multi-layer substrate is a 4-layer substrate first and second layers are provided with a microstrip line and third and fourth layers are provided with another microstrip line. The probe is attached at the first pattern layer and if a signal received by the probe is propagated by the first pattern layer a loss occurs as the second layer corresponding to a ground layer and the chassis cannot directly contact each other and sandwich the third and fourth layer. By arranging the third and fourth layers' pattern layouts such that at least one of the third and fourth, pattern layers and a dielectric layer are minimally posed between a region of the second layer's pattern that surrounds the probe and the chassis, improved transit characteristic and reduced loss can be provided.

Furthermore the 4-layer substrate can have the third layer's ground pattern and/or the fourth layer's ground pattern isolated and allowed to conduct with respect to another layer through a throughhole to provide further improved transit characteristic.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Reference will now be made to the drawings to describe the present invention in embodiments.

First Embodiment

Figure 1:
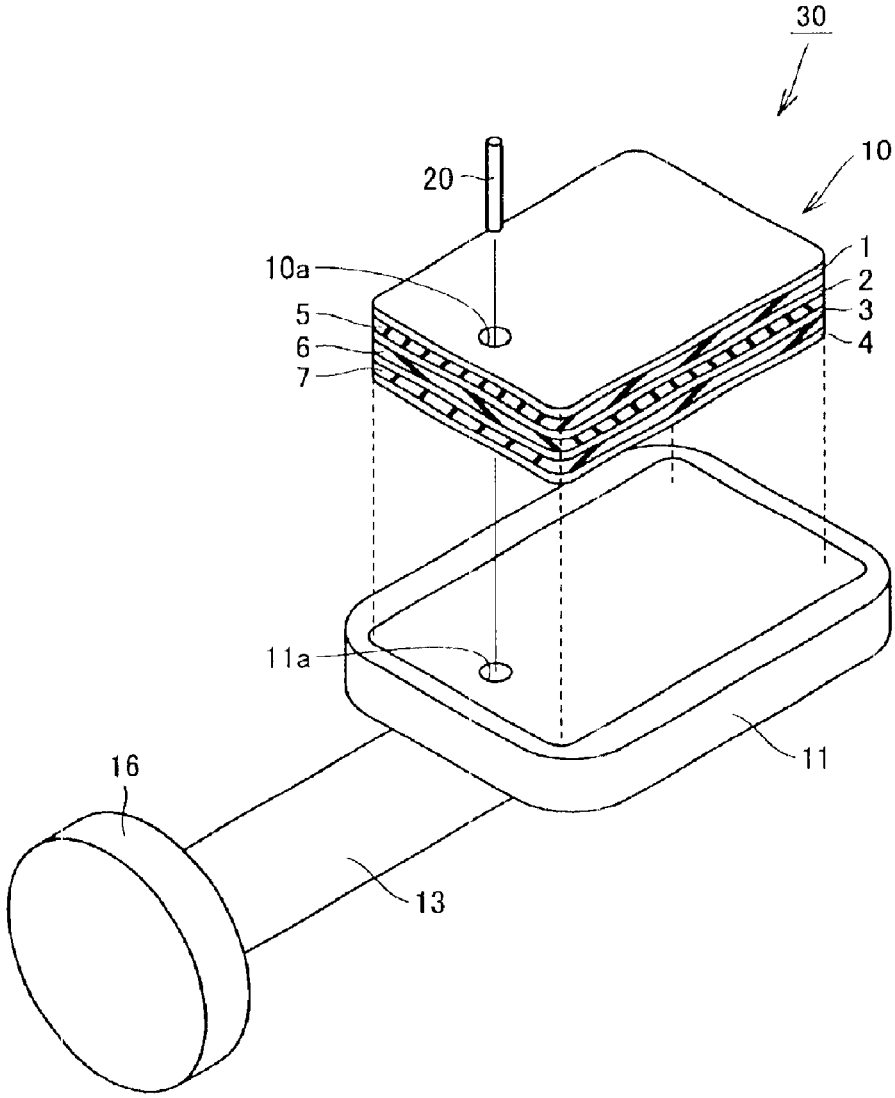
FIG. 1 is an exploded, perspective view of an LNB converter of the present invention in a first embodiment.

FIG. 1 shows an LNB converter 30 including an electric wave receiving portion 16 receiving a weak signal transmitted from a satellite, a waveguide 13 propagating the received signal, a 4-layer substrate 10, a probe 20 soldered to substrate 10 substantially perpendicularly and receiving the propagated signal and then transmitting the signal to a low noise amplifier. Probe 20 penetrates substrate 10 through a hole 10*a* provided in the substrate to attach the probe and is received by a hole 11*a* provided in a chassis 11 to receive the probe.

Figure 2:
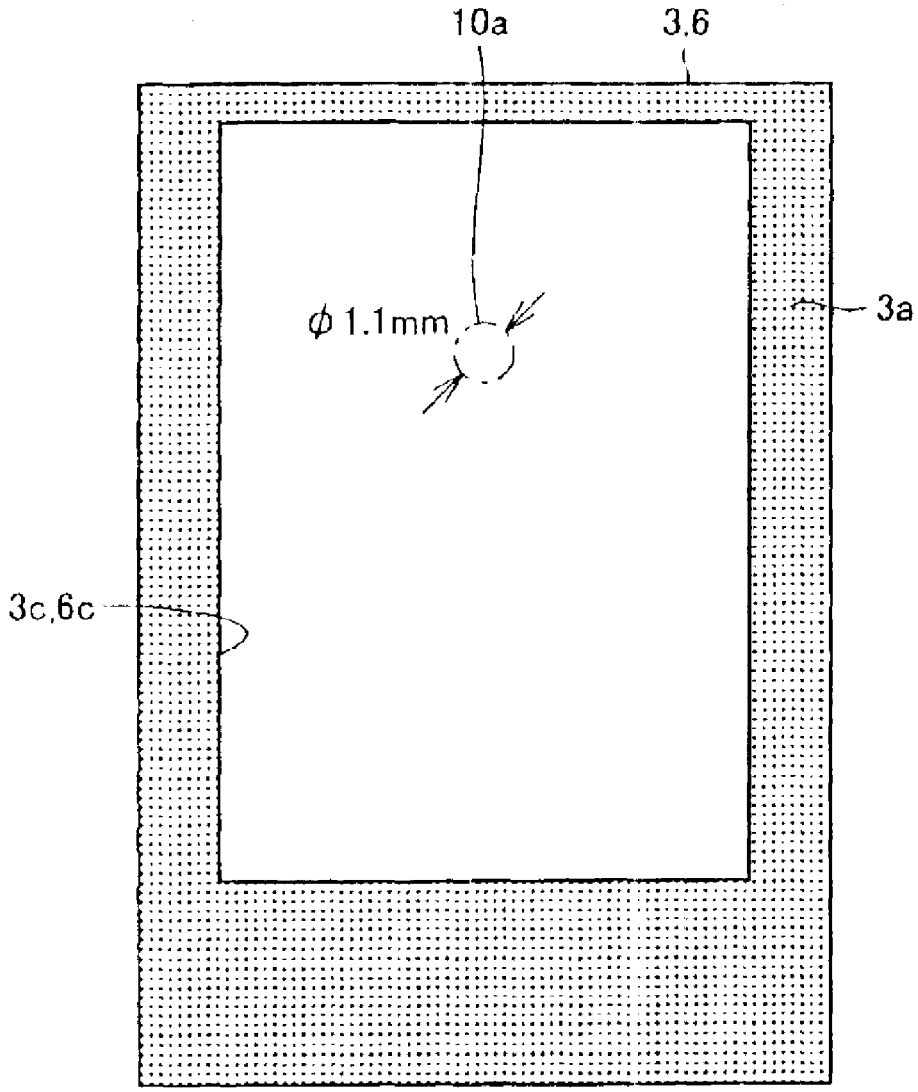
FIGS. 2, 3 and 4 are plan views of third, fourth and second layers, respectively, of a 4-layer substrate used in the FIG. 1 LNB converter, as seen from a pattern layer (or upward)
Figure 3:
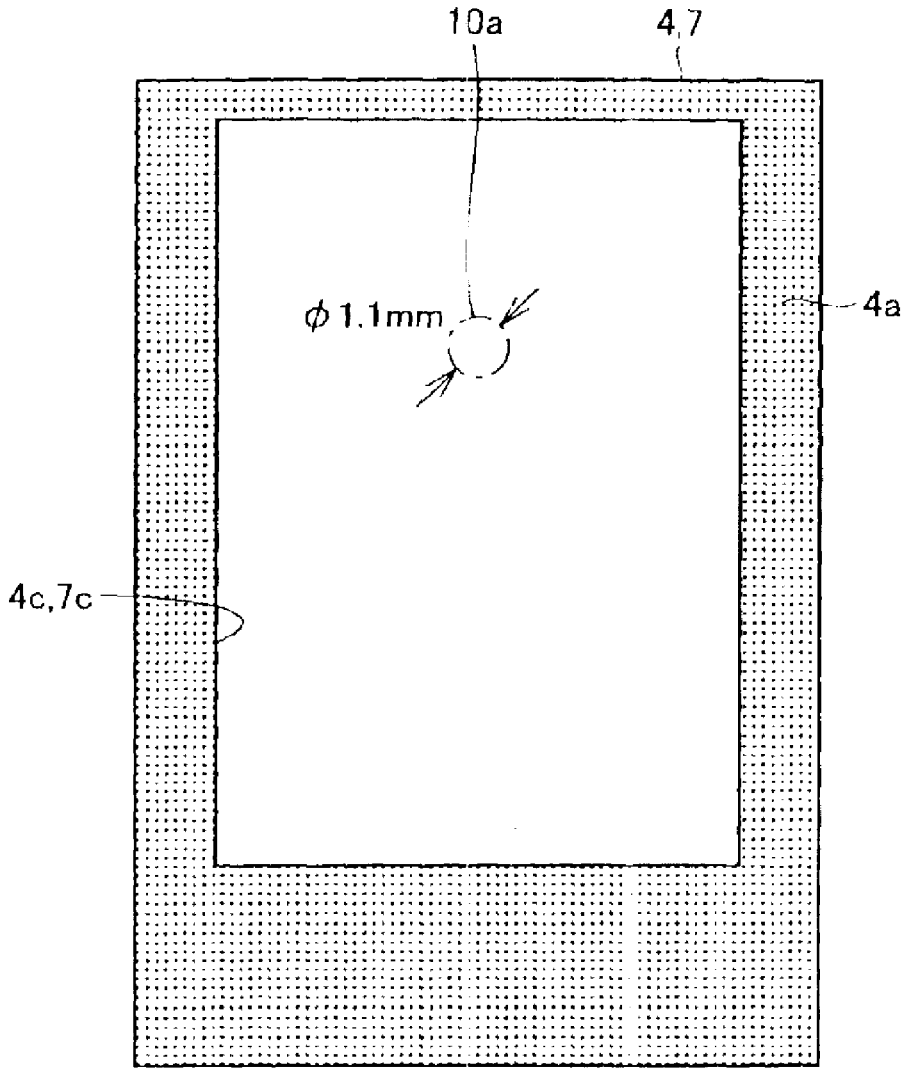
Figure 4:
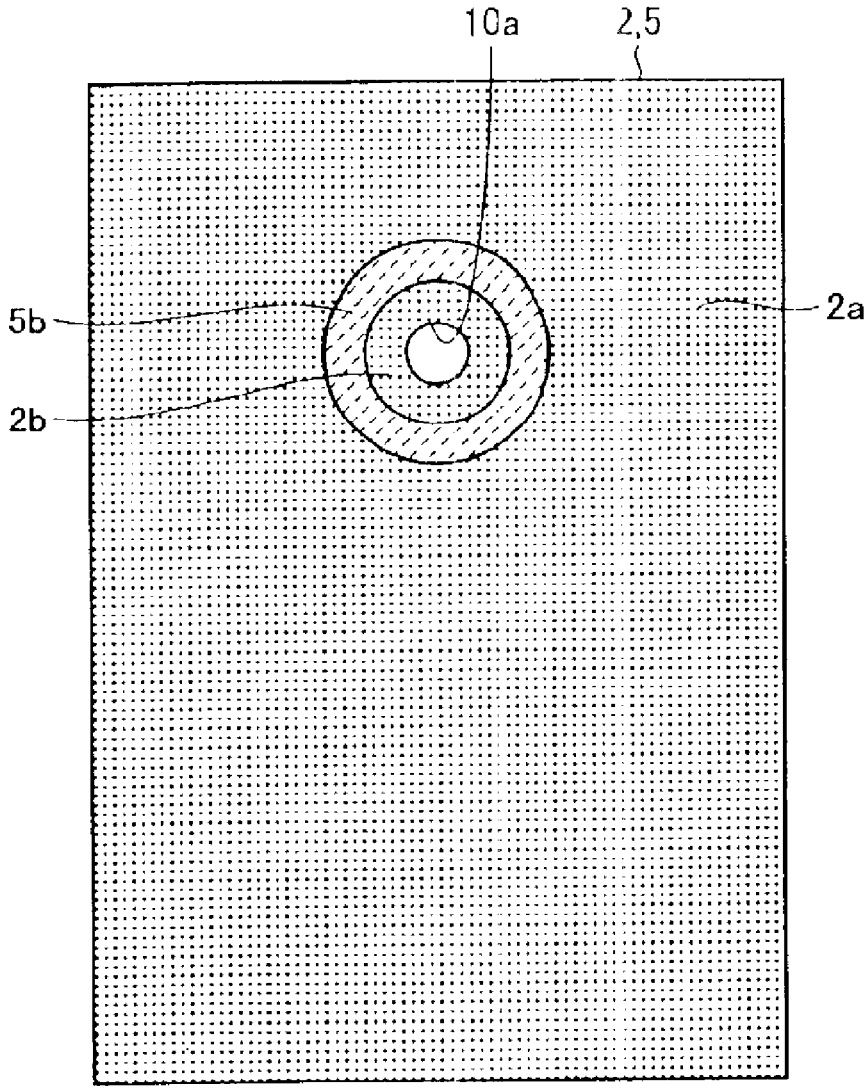

The 4-layer substrate includes a topmost or first layer's pattern 1, a second layer's pattern 2 underlying pattern 1, a third layer's pattern 3 underlying pattern 2 and a fourth layer's pattern underlying pattern 3, and dielectric layers 5, 6, 7 disposed between the pattern layers. As shown in FIGS. 2 and 3, the third and fourth, pattern layers have a portion corresponding to hole 10*a* and a region surrounding the hole removed to have a pattern-free, open region 3*c*, 4*c*. Dielectric layer 6 overlying the third, pattern layer and dielectric layer 7 overlaying the fourth, pattern layer also similarly have dielectric-free, open regions 6*c*, 7*c*. More specifically, the first and second layers are provided with a throughhole of ϕ 1.1 mm in diameter required for attaching the probe and the third and fourth layers at a portion surrounding the probe are removed together with the respectively overlying dielectric layers to provide an opening substantially in a rectangle having a longer side of 9 mm and a shorter side of 7 mm. The third and fourth, pattern layers include grounds 3*a*, 4*a* in regions other than open regions 3*c*, 4*c*, respectively. By contrast, the second, pattern layer includes a ground 2*a*, as conventional, across a region excluding probe hole 10*a* and a throughhole land 2*b* and surrounding probe hole 10*a*, as shown in FIG. 4. If the 4-layer substrate thus structured has the first and second, pattern layers forming a microstrip line and ground layer 2*a* arranged as shown in FIG. 4, the third, ground layer and the fourth layer's ground pattern are not located between the chassis and the second, ground layer.

Figure 5:
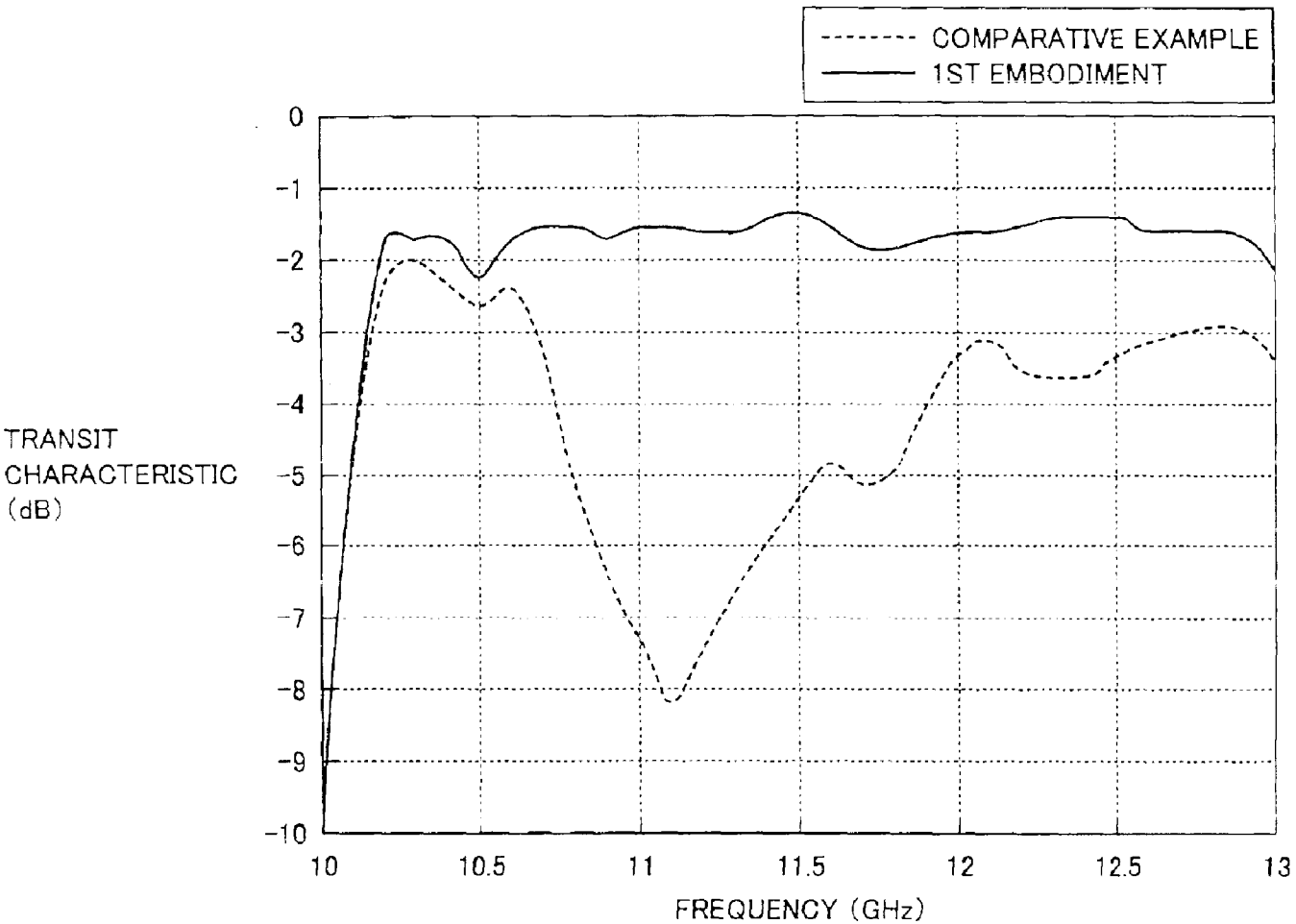
FIG. 5 represents a measurement of a transit characteristic of the LNB converter in the first embodiment.
Figure 46:
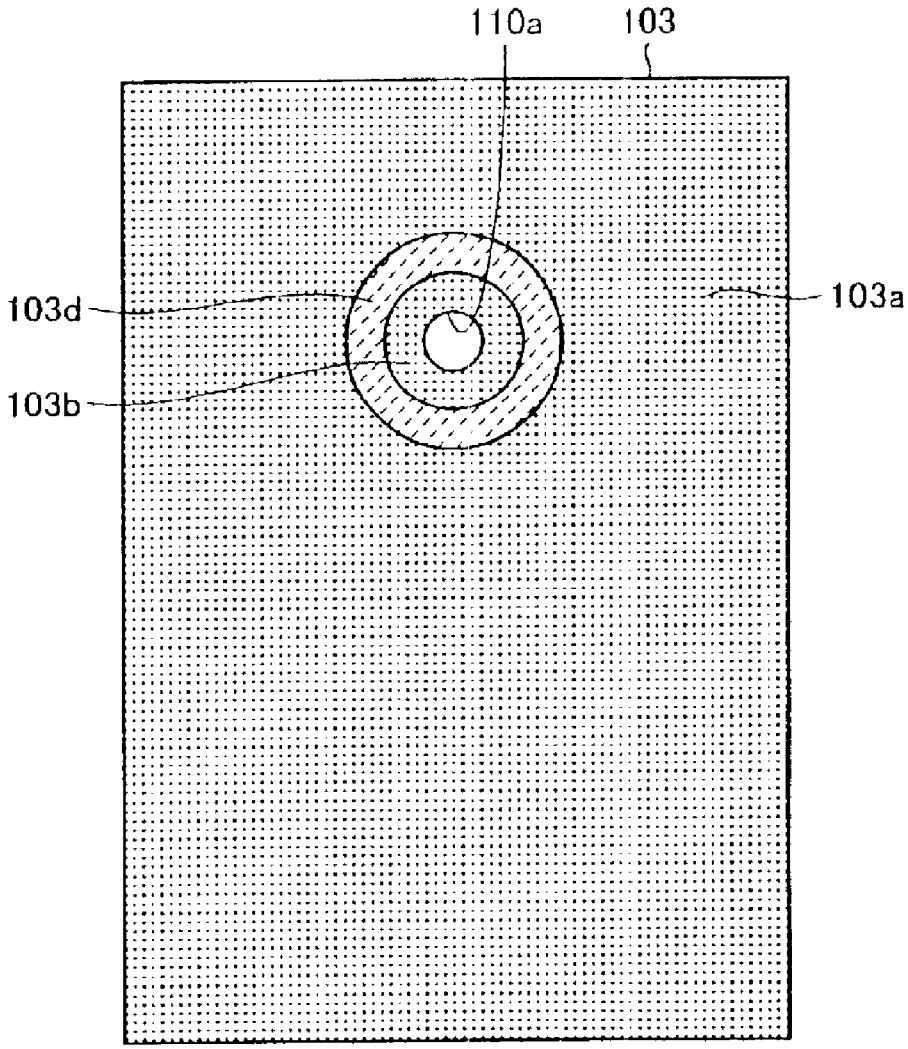
FIG.46 PRIOR ART
FIGS. 46 and 47 are plan views of patterns of third and fourth layers, respectively, of a conventional 4-layer substrate, as seen from a pattern layer (or upward).
Figure 47:
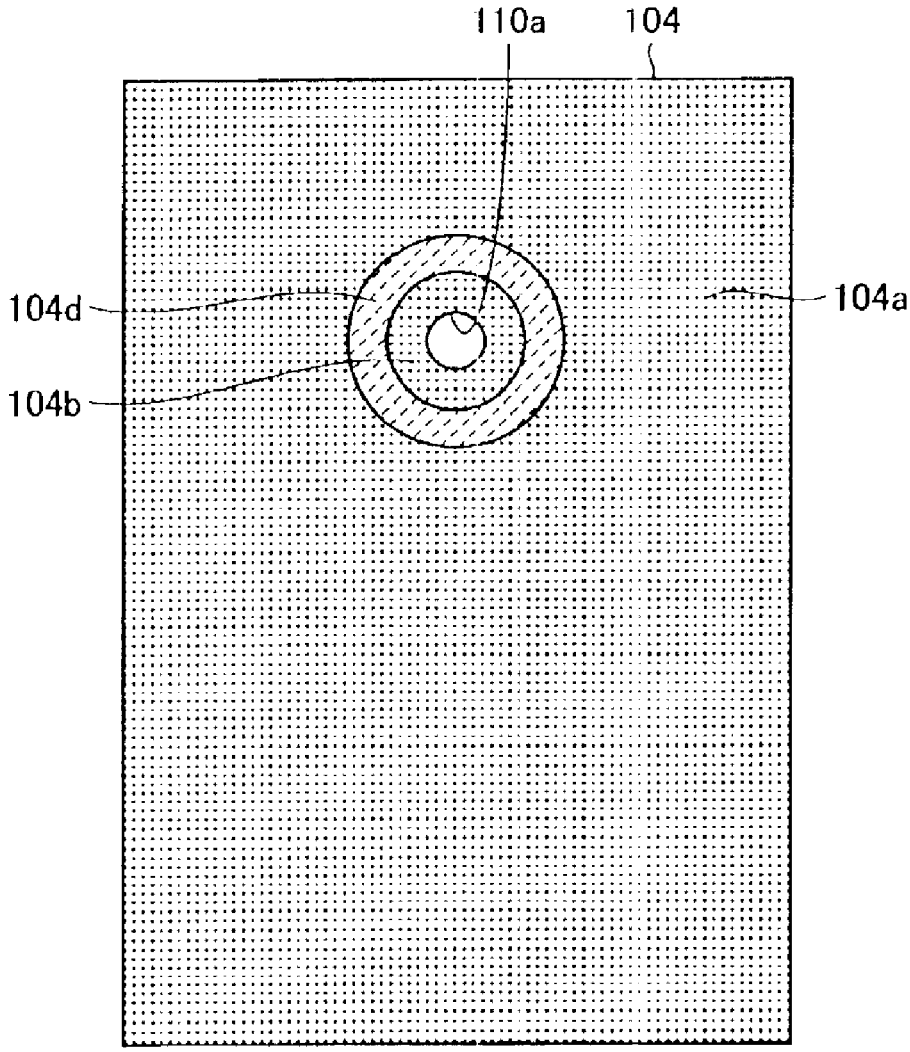
FIG.47 PRIOR ART

FIG. 5 represents a transit characteristic in the present embodiment, as compared with that of a 4-layer substrate employing conventional third and fourth, pattern and dielectric layers as shown in FIGS. 46 and 47. The comparative example provides a significant deterioration for a range from 10.6 to 13 GHz, whereas the present embodiment exhibits an adequate transit characteristic across the entire frequency range. This is because the second layer's ground is exposed on a rear side to prevent the probe hole and a ground therearound, and a dielectric layer from filling it, as shown in FIGS. 2 and 3.

Second Embodiment

Figure 6:
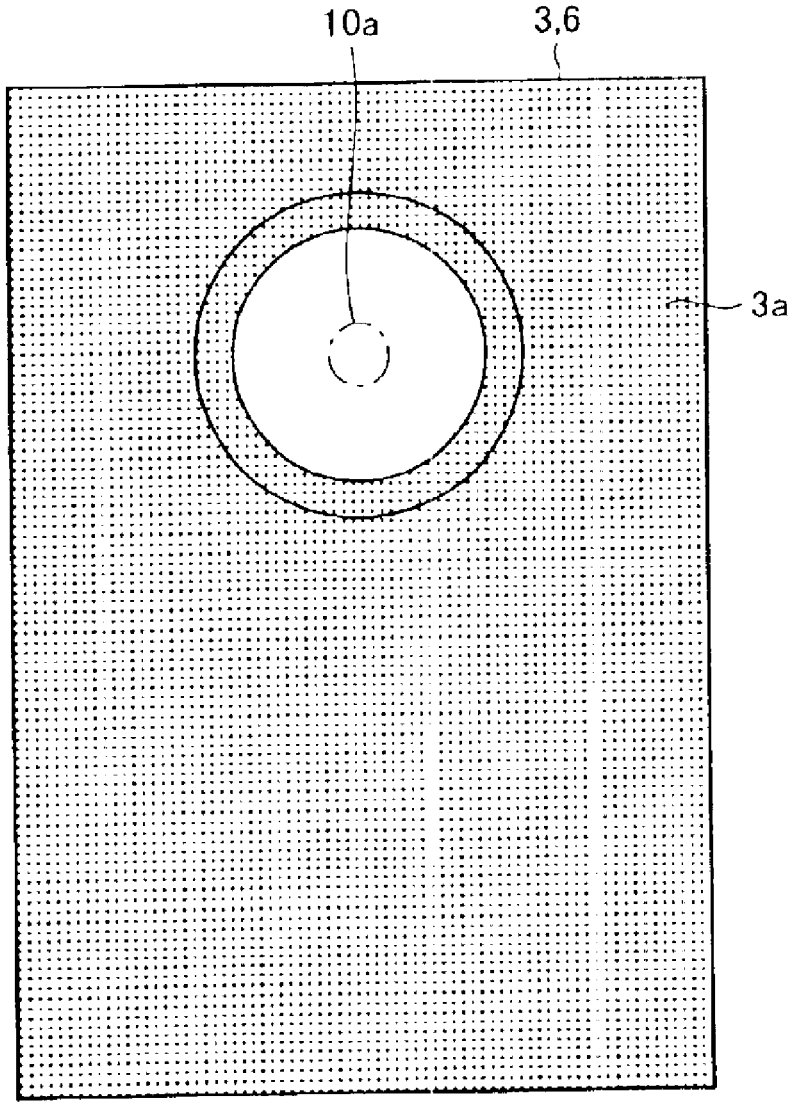
FIGS. 6 and 7 are plan views of third and fourth layers, respectively, of the 4-layer substrate used in the LNB converter of the present invention in a second embodiment, as seen from a pattern layer (or upward)
Figure 7:
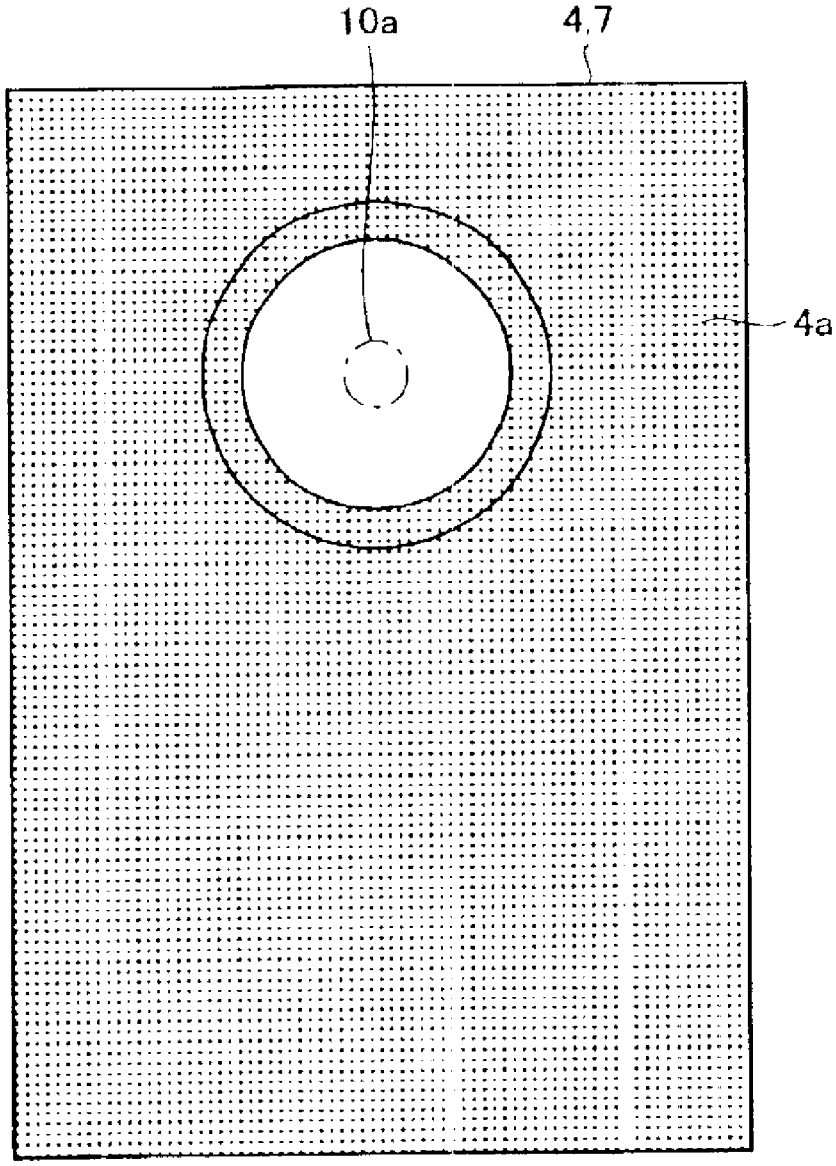

FIGS. 6 and 7 show third and fourth, pattern layers of the 4-layer substrate of the LNB converter of the present invention, and dielectric layers overlying the pattern layers, respectively. The pattern and overlying dielectric layers that have a large open region including a probe hole, a throughhole for attaching the probe, and a region surrounding the hole, can provide an improved transit characteristic. While in the first embodiment a rectangular open region is provided, a round open region, as shown in FIGS. 6 and 7, can be as effective as the first embodiment.

Third Embodiment

Figure 8:
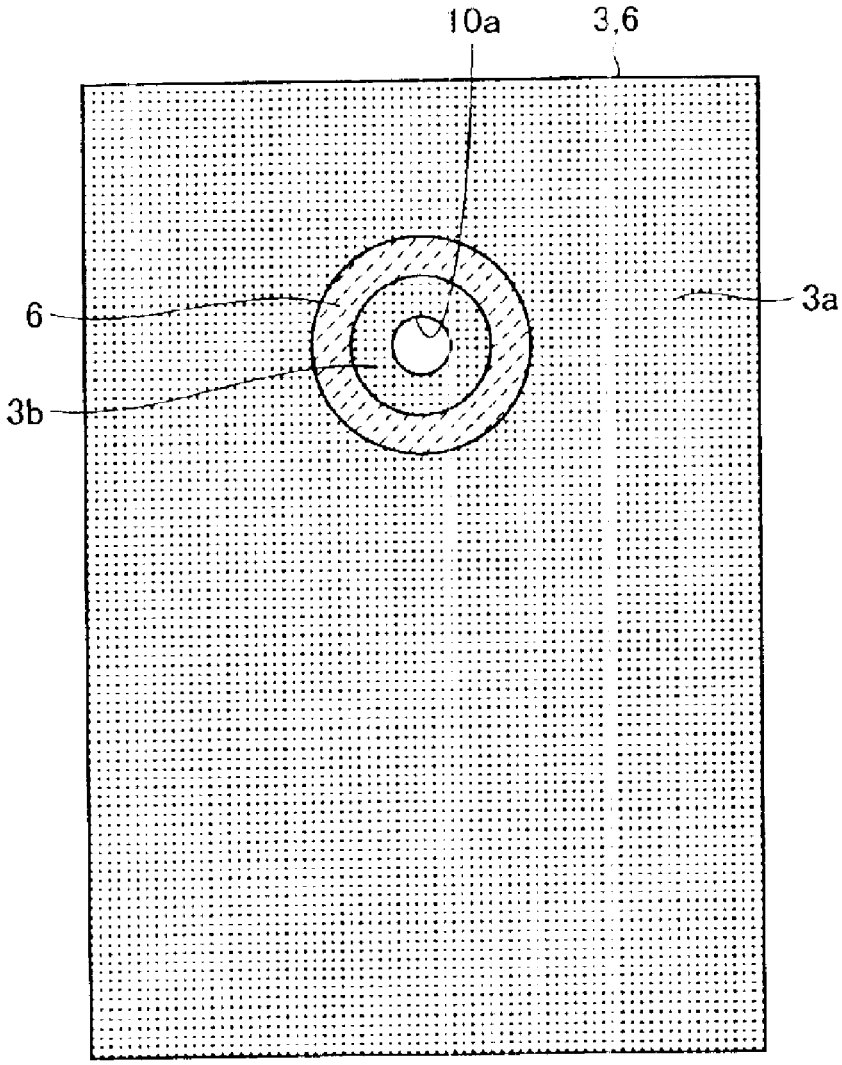
FIGS. 8 and 9 are plan views of third and fourth layers, respectively, of the 4-layer substrate used in the LNB converter of the present invention in a third embodiment, as seen from a pattern layer (or upward)
Figure 9:
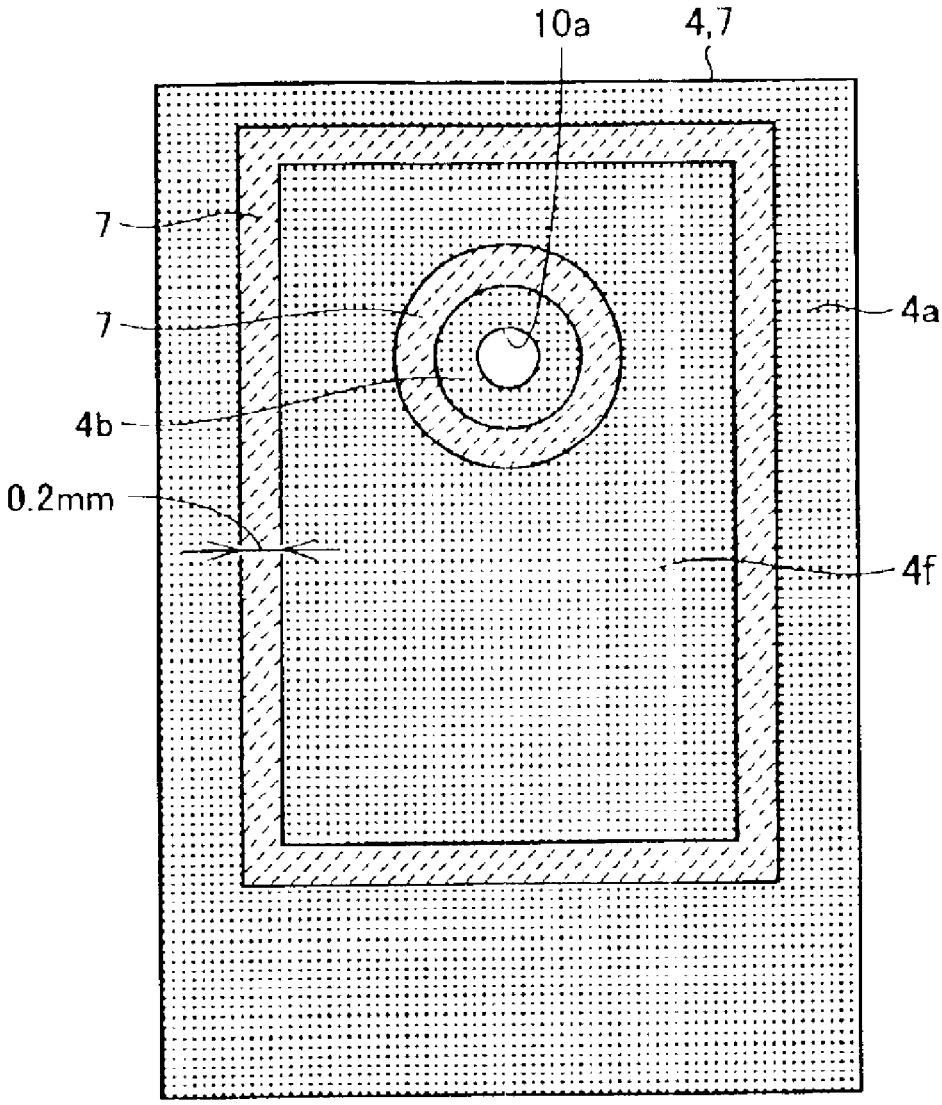

FIGS. 8 and 9 show third and fourth, pattern layers of the 4-layer substrate of the LNB converter of the present invention, and dielectric layers overlying the pattern layers, respectively. With reference to FIG. 8, the third layer's pattern has probe hole 10 surrounded by a throughhole land 3*b* electrically isolated from the third layer's outer pattern. This portion is similar to portion 2*b* surrounding the probe hole of the pattern of the second layer as shown in FIG. 4. The fourth layer's pattern has a probe hole surrounded by an electrically isolated throughhole land 4*b* and outer than throughhole land 4*b* the ground pattern has a rectangular region 4*f* having a longer side of 9 mm and a shorter side of 7 mm and electrically isolated from a further surrounding region 4*a*. Between rectangular, isolated region 4*f* and outer ground pattern region 4*a* an isolation band of 0.2 mm in width is provided. The regions are both provided with a ground pattern. From surrounding ground pattern 4*a* a spacing of 0.2 mm is provided. In FIGS. 8 and 9, the pattern layers underlie dielectric layers 6, 7 having no portion removed therefrom, except for probe hole 10*a*. Note that the isolation band surrounding the throughhole land will be referred to as an inner isolation band and that surrounding the rectangle will be referred to as an outer isolation band.

Figure 10:
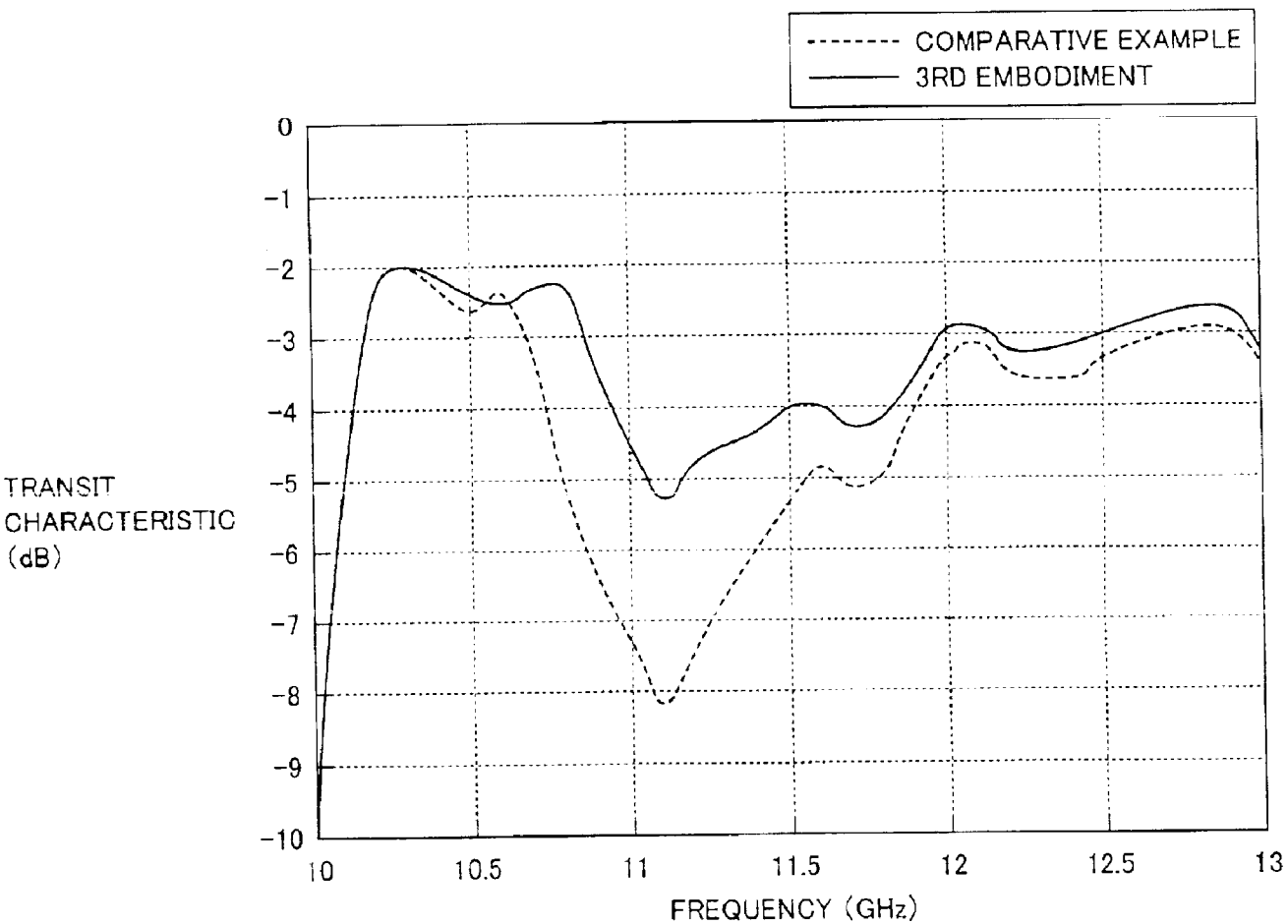
FIG. 10 represents a measurement of a transit characteristic of the LNB converter in the third embodiment.

FIG. 10 represents a transit characteristic of an LNB converter employing the above described 4-layer substrate, together with that of an comparative example identical to that in the first embodiment. As shown in FIG. 10, the LNB converter of the present embodiment exhibits a transit characteristic peaking for 11 GHz and deteriorating for frequency ranges sandwiching the peak. However, the deterioration from the peak is approximately 3 dB which is smaller by 3 dB than that of the comparative example, showing a decrease of 6 dB. This improvement is a large value for practical use and important in ensuring that the 4-layer substrate provides for adequate transit characteristic.

Fourth Embodiment

Figure 11:
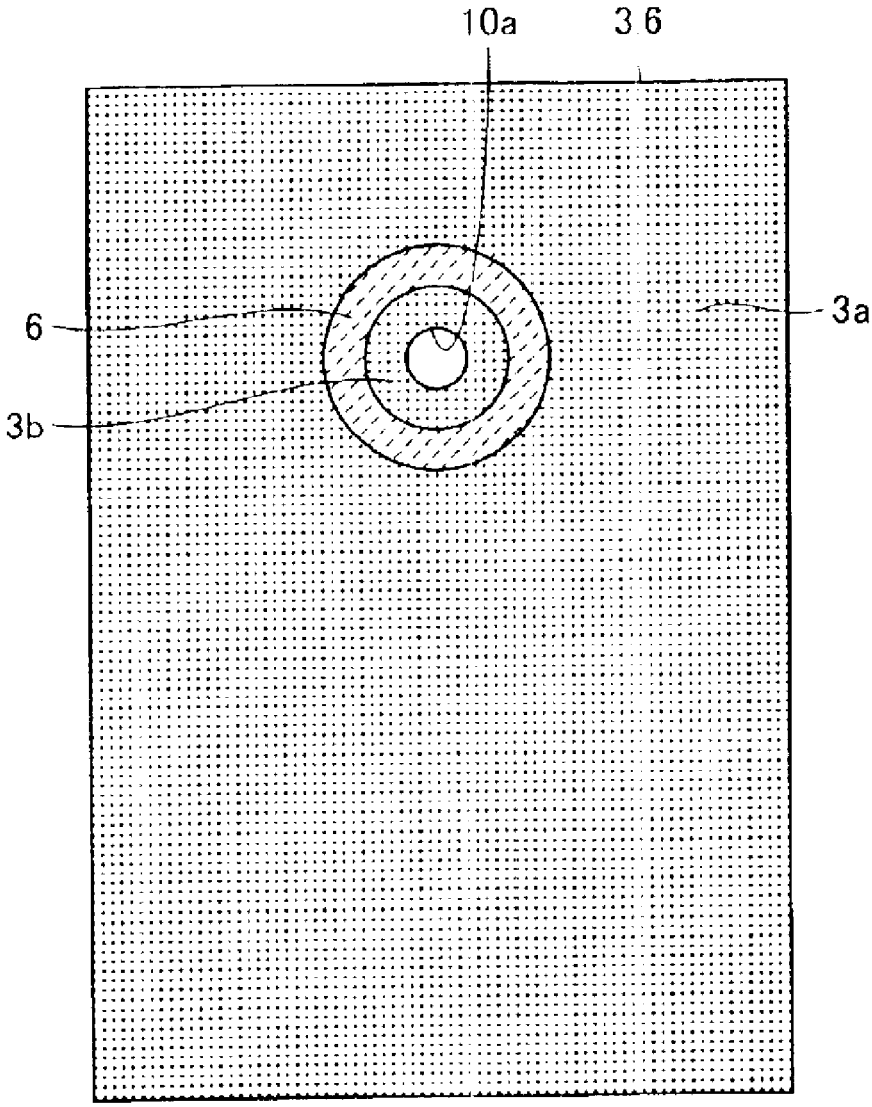
FIGS. 11 and 12 are plan views of third and fourth layers, respectively, of the 4-layer substrate used in the LNB converter of the present invention in a fourth embodiment, as seen from a pattern layer (or upward)
Figure 12:
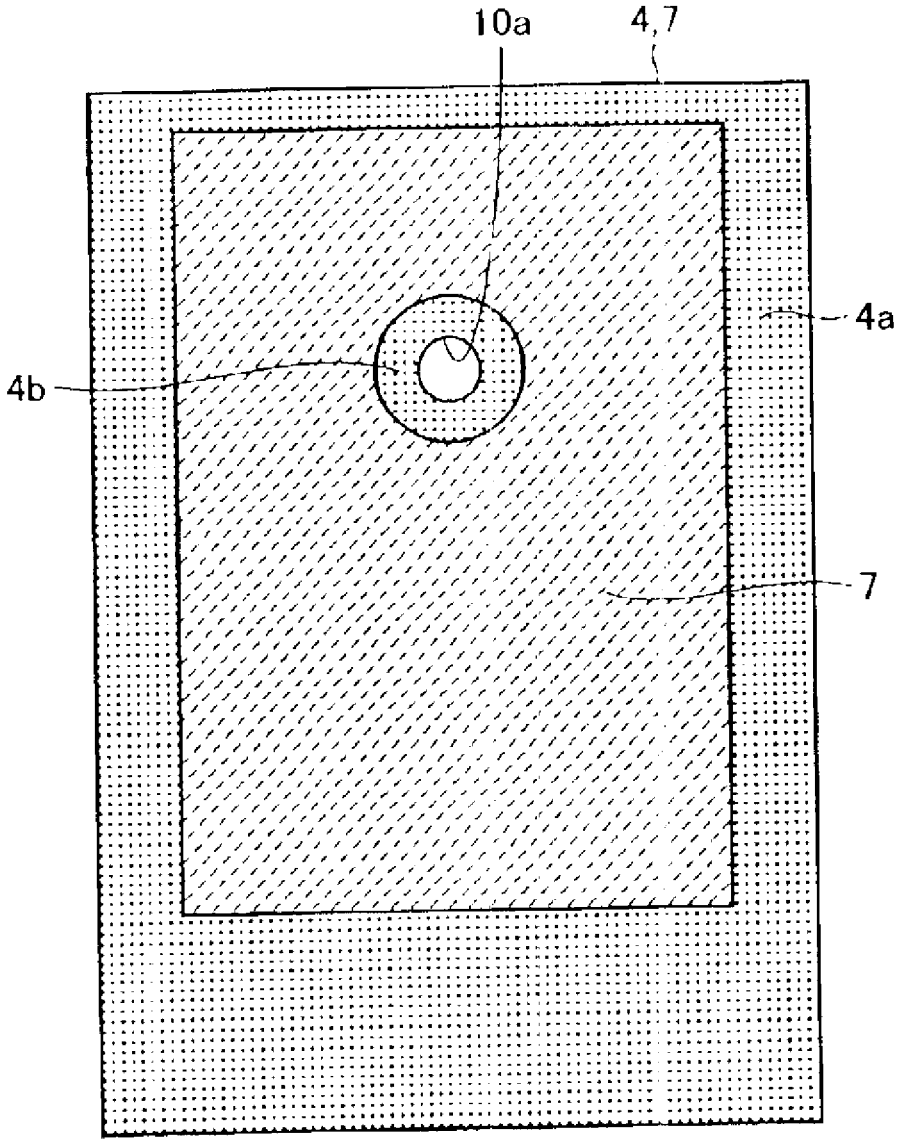

FIGS. 11 and 12 show third and fourth, pattern layers of the 4-layer substrate of the LNB converter of the present invention, and dielectric layers overlying the pattern layers, respectively. The third, pattern layer and the overlying dielectric layer are identical to those described in the third embodiment. The present embodiment is characterized in that the fourth layer has a ground pattern removed in a rectangle having a longer side of 9 mm and a shorter side of 7 mm, surrounding the probe and excluding a probe attaching throughhole land 4*b*.

Figure 13:
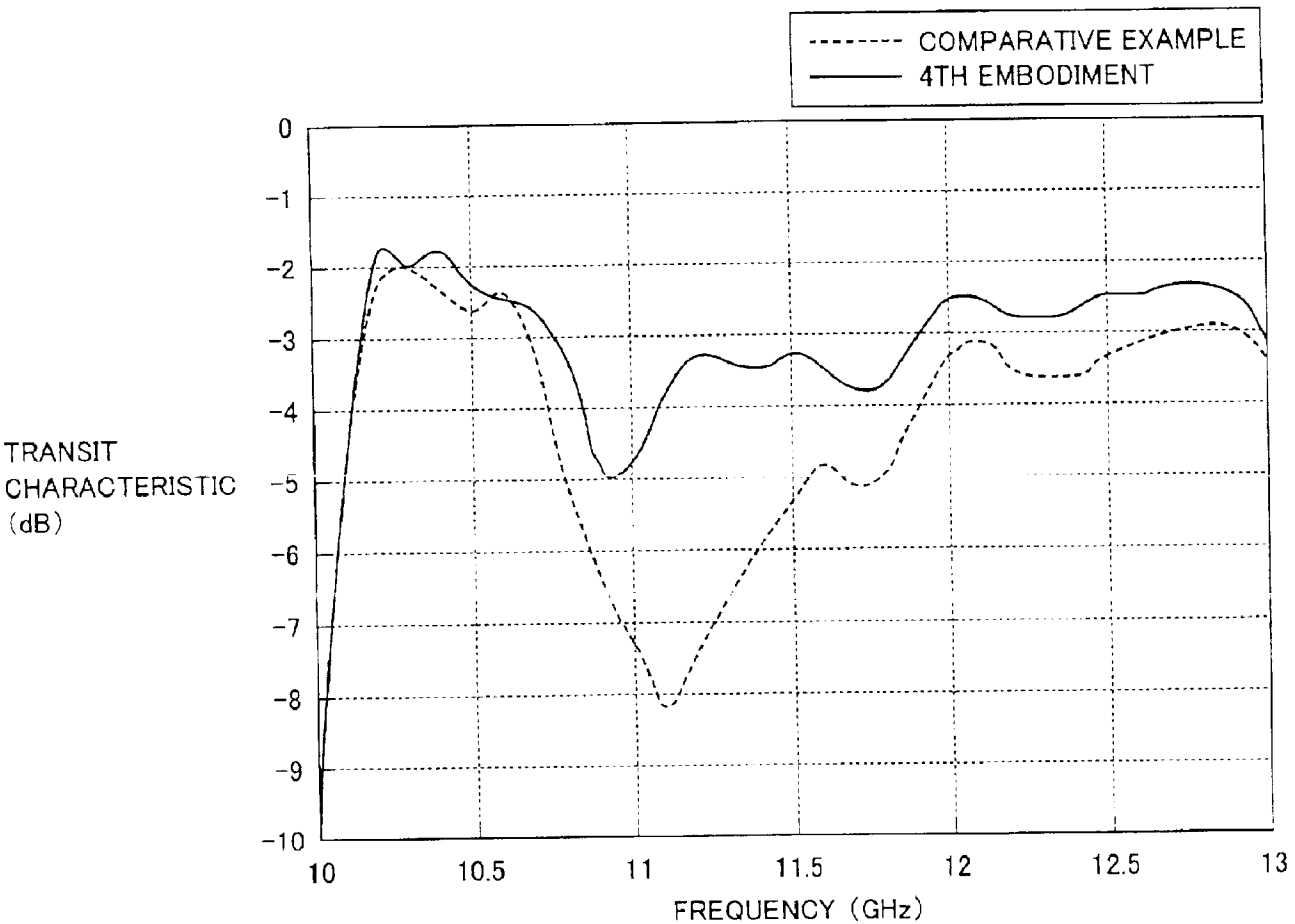
FIG. 13 represents a measurement of a transit characteristic of the LNB converter in the fourth embodiment.

FIG. 13 represents a measurement of a transit characteristic of an LNB converter employing the 4-layer substrate of the present embodiment. It can be seen from FIG. 13 that a result better than that in the third embodiment can be obtained.

Fifth Embodiment

Figure 14:
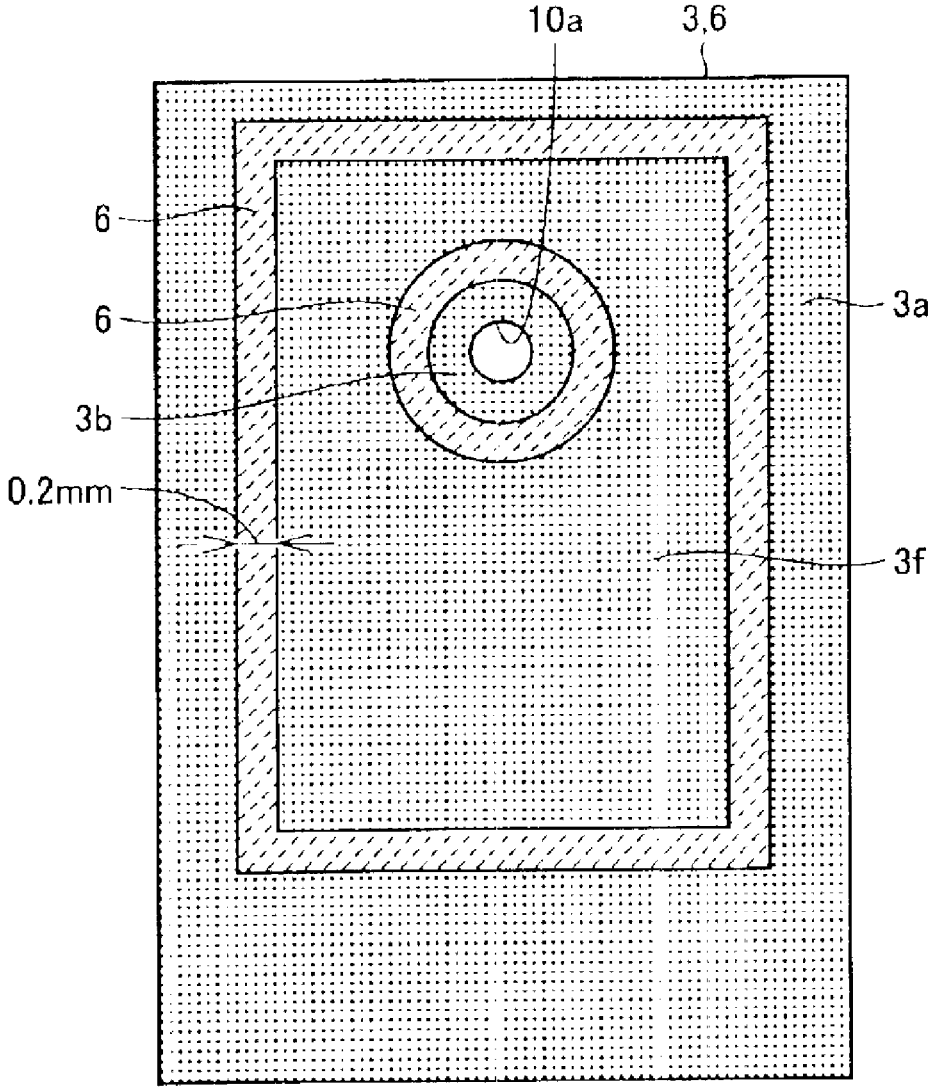
FIGS. 14 and 15 are plan views of third and fourth layers, respectively, of the 4-layer substrate used in the LNB converter of the present invention in a fifth embodiment, as seen from a pattern layer (or upward)
Figure 15:
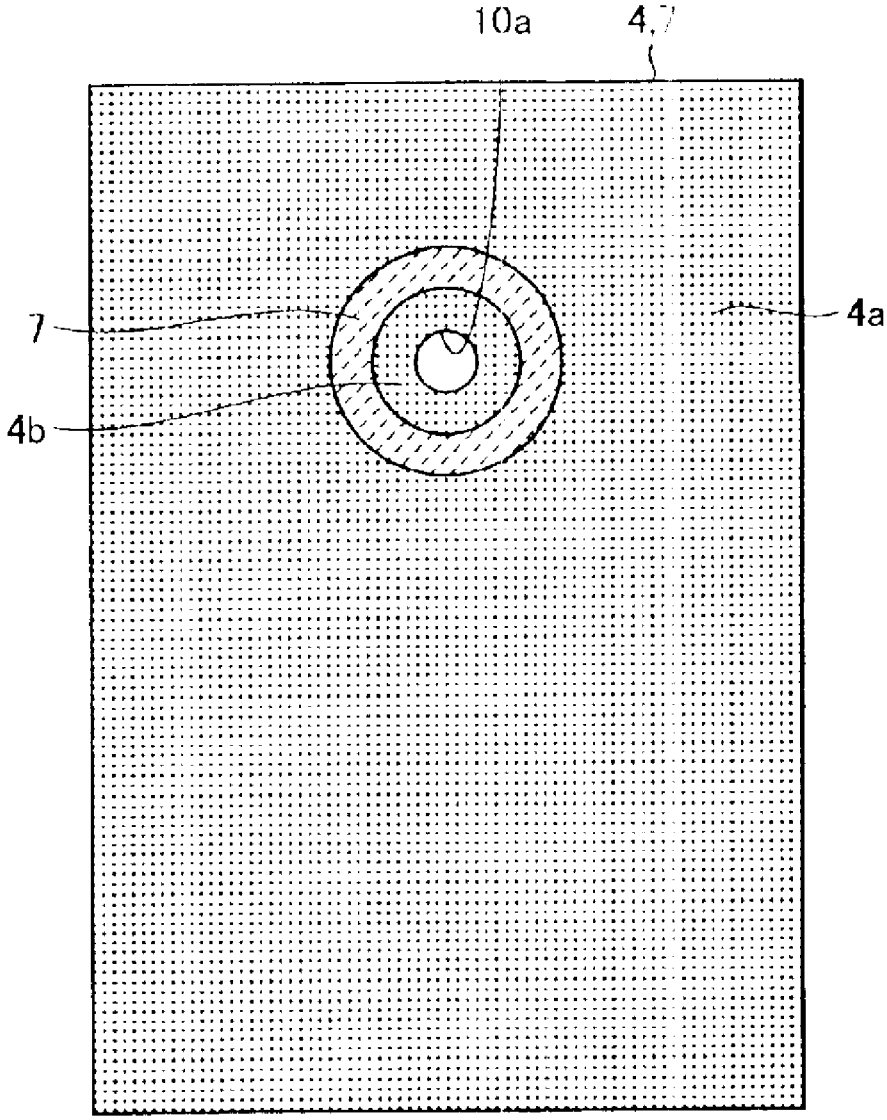

FIGS. 14 and 15 show third and fourth, pattern layers of the 4-layer substrate of the LNB converter of the present invention, and dielectric layers overlying the pattern layers, respectively. The fourth, pattern layer and the overlying dielectric layer are similar to the conventional pattern shown in FIG. 47. The present embodiment is characterized in that the third layer has a pattern surrounding a probe with a ground pattern of a rectangle (isolated region) 3*f* having a longer side of 9 mm and a shorter side of 7 mm and spaced from a surrounding ground pattern 2*a* by 0.2 mm.

The 4-layer substrate thus structured can reduce an effect at the third and fourth, pattern layers that is introduced when a ground layer in a microstrip line provided in the first and second, pattern layers is provided in the second, pattern layer. It can provide transit characteristic free of deterioration exceeding a predetermined range.

Sixth Embodiment

Figure 16:
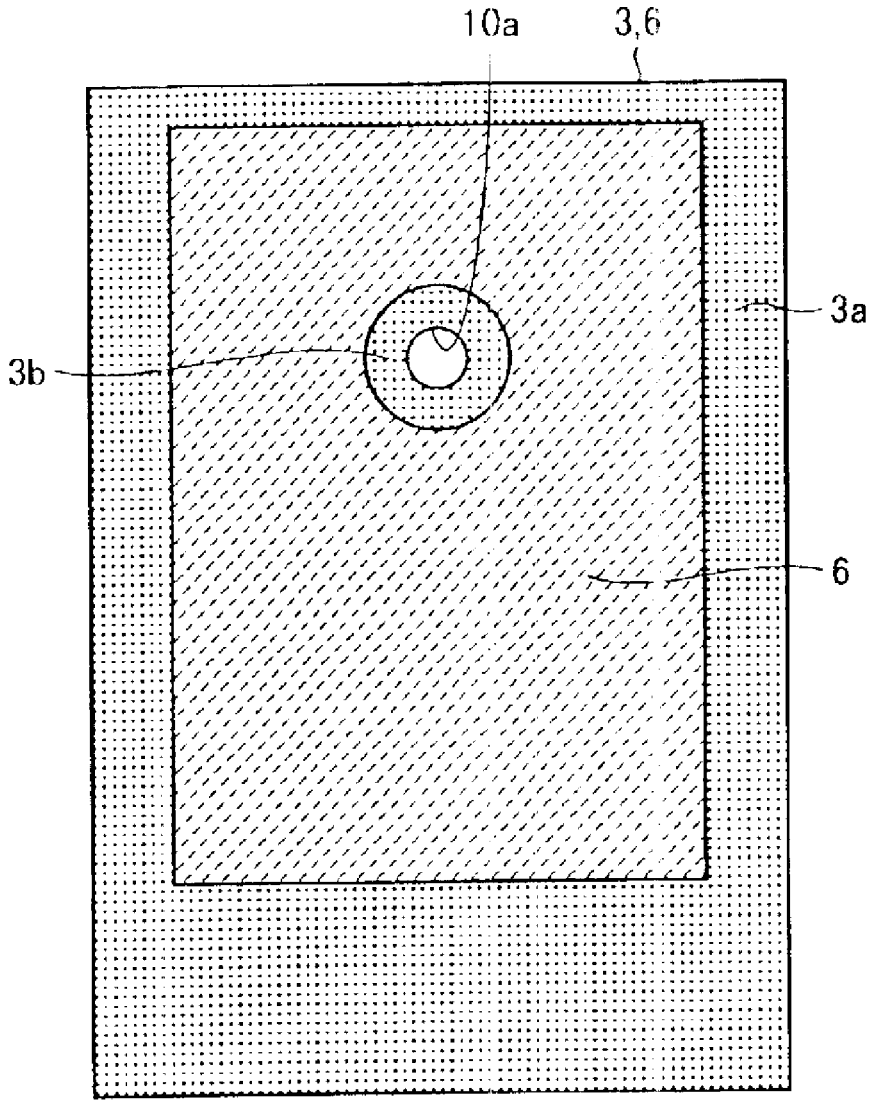
FIGS. 16 and 17 are plan views of third and fourth layers, respectively, of the 4-layer substrate used in the LNB converter of the present invention in a sixth embodiment, as seen from a pattern layer (or upward)
Figure 17:
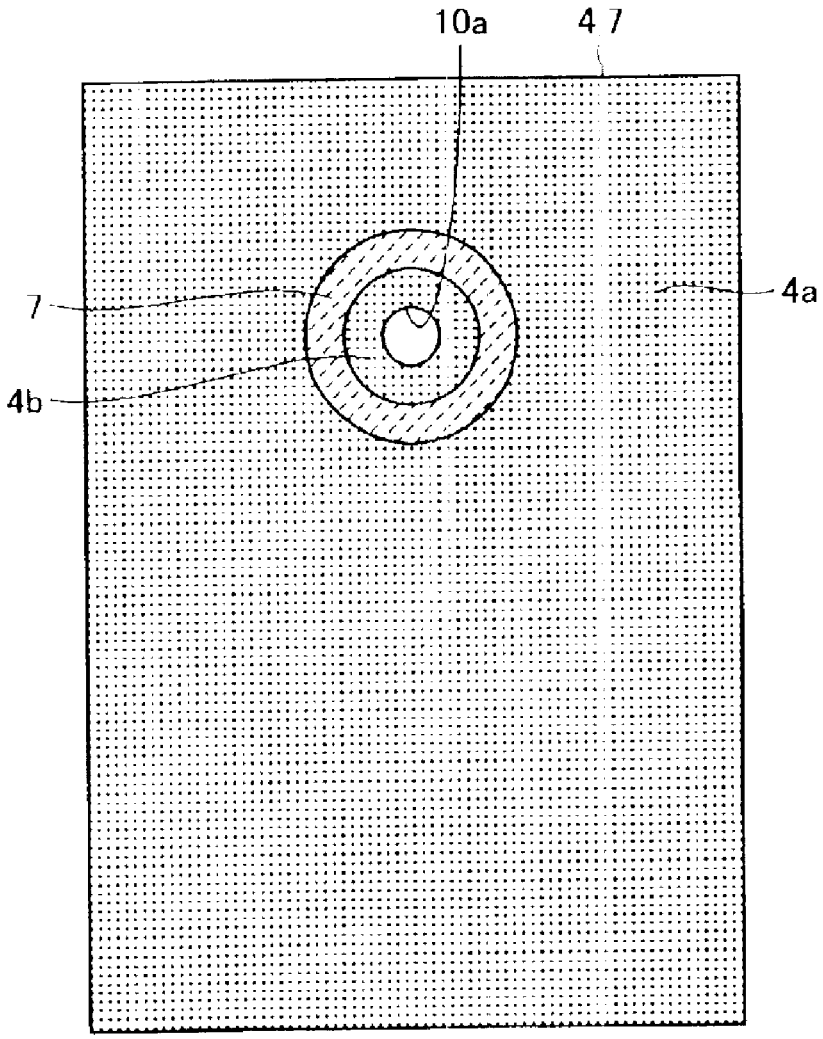

FIGS. 16 and 17 show third and fourth, pattern layers of the 4-layer substrate of the LNB converter of the present invention, and dielectric layers overlying the pattern layers, respectively. The fourth, pattern layer and the overlying dielectric layer are similar to the conventional pattern of FIG. 47. The present embodiment is characterized in that the third, pattern layer has a ground pattern removed in a rectangle having a longer side of 9 mm and a shorter side of 7 mm and surrounding the probe.

Figure 18:
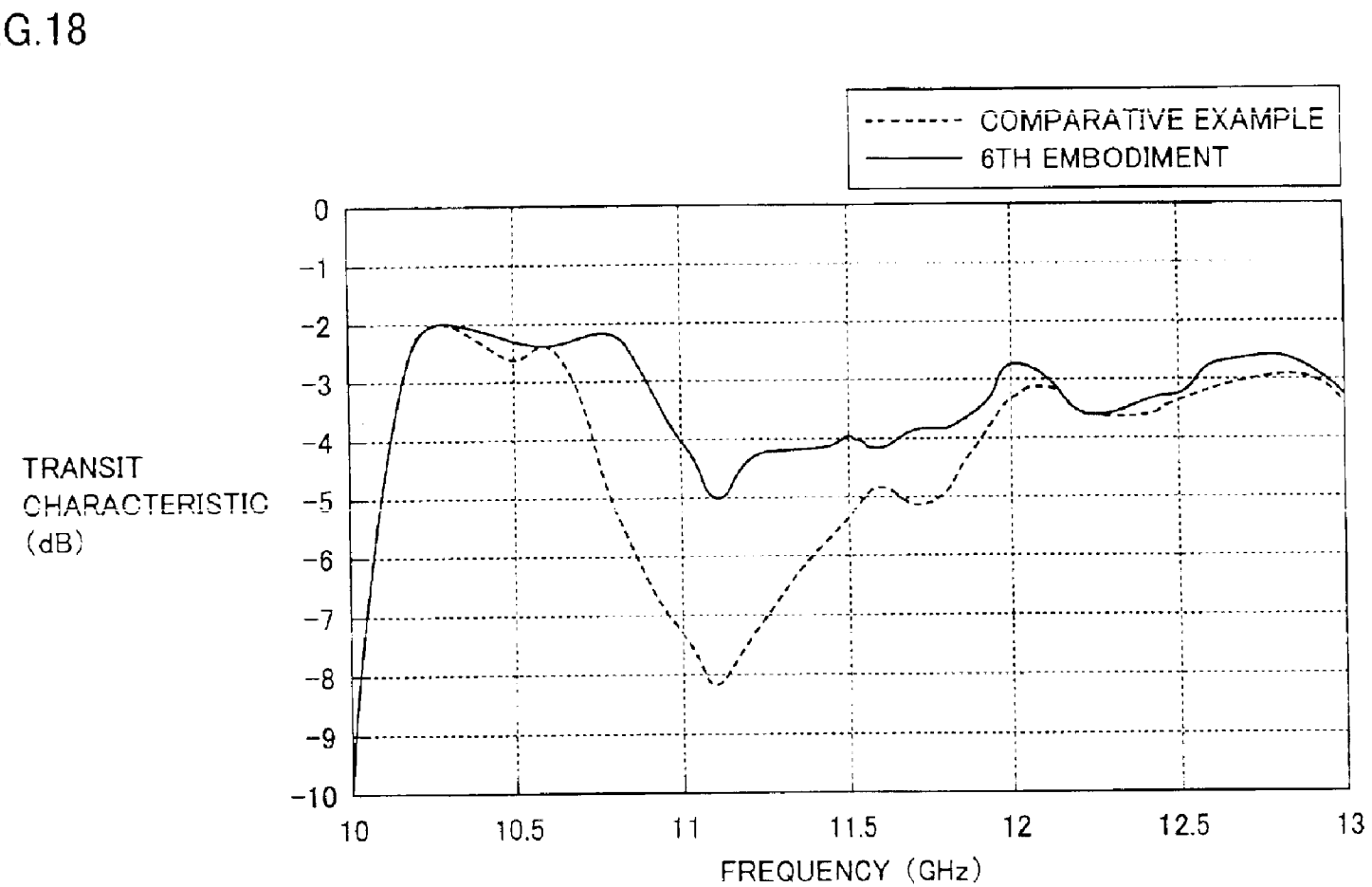
FIG. 18 represents a measurement of a transit characteristic of the LNB converter in the sixth embodiment.

FIG. 18 represents a measurement of a transit characteristic of an LNB converter employing the 4-layer substrate of the present embodiment. It can be seen from FIG. 18 that a result better than that in the third embodiment can be obtained.

Seventh Embodiment

Figure 19:
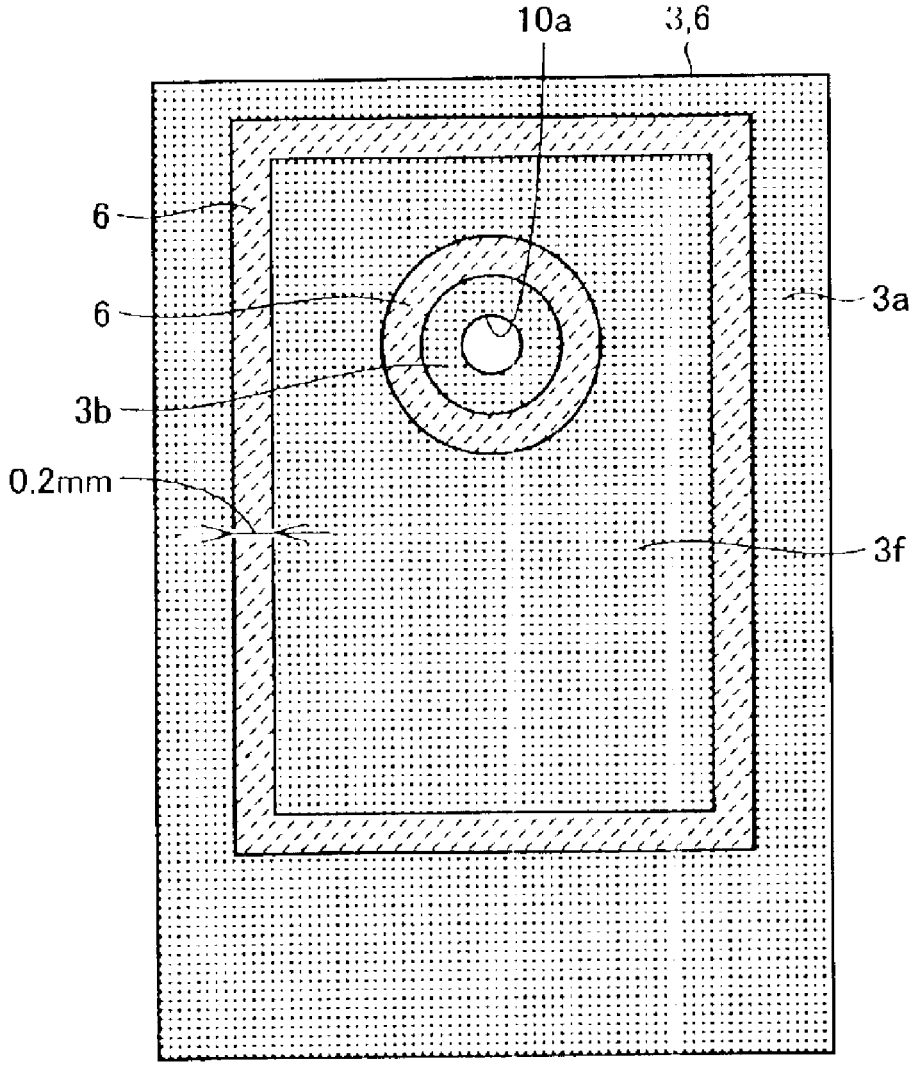
FIGS. 19 and 20 are plan views of third and fourth layers, respectively, of the 4-layer substrate used in the LNB converter of the present invention in a seventh embodiment, as seen from a pattern layer (or upward)
Figure 20:
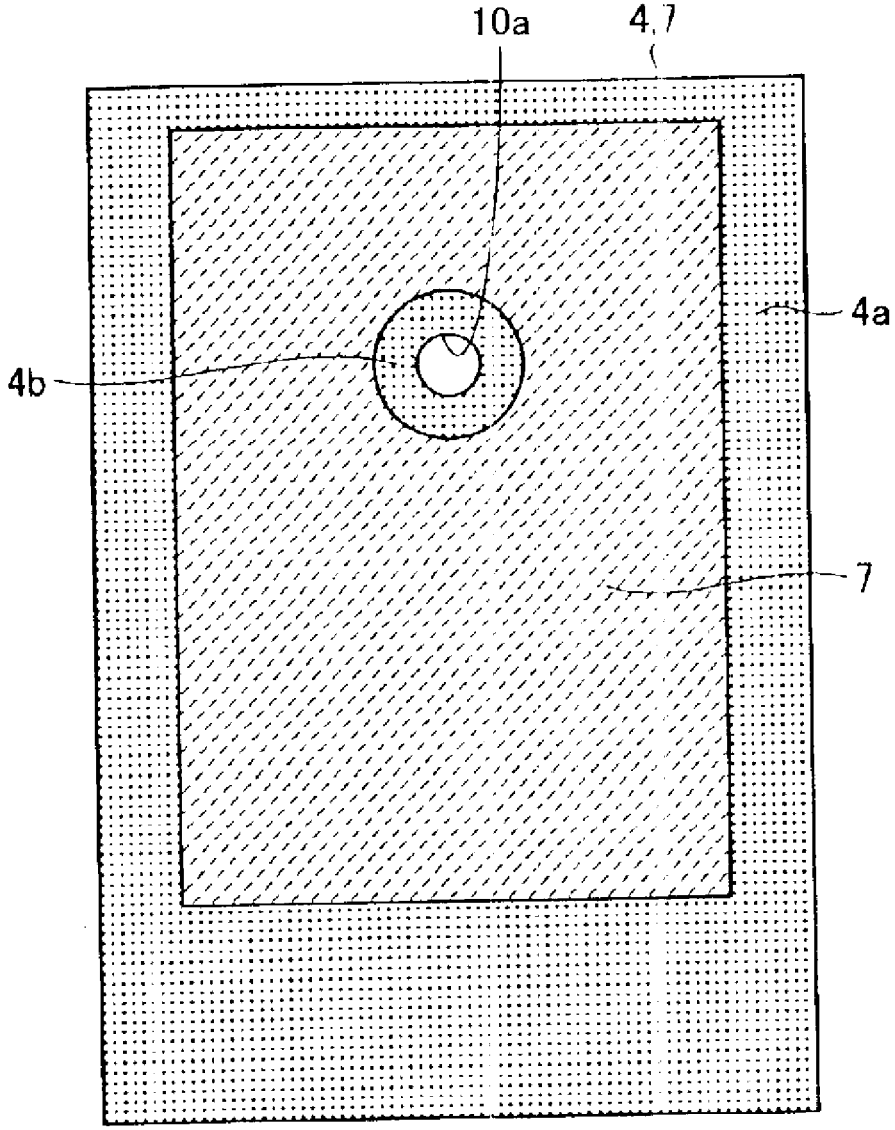

FIGS. 19 and 20 show third and fourth, pattern layers of the 4-layer substrate of the LNB converter of the present invention, and dielectric layers overlying the pattern layers, respectively. The present embodiment is characterized in that the third layer has a pattern surrounding a probe with a ground pattern of a rectangle 3*f* having a longer side of 9 mm and a shorter side of 7 mm and spaced from a surrounding ground pattern 3*a* by 0.2 mm. Furthermore, the fourth layer has a pattern with a ground pattern removed in a rectangle having a longer side of 9 mm and a shorter side of 7 mm, surrounding the probe and excluding a probe attaching throughhole land 4*b*.

Figure 21:
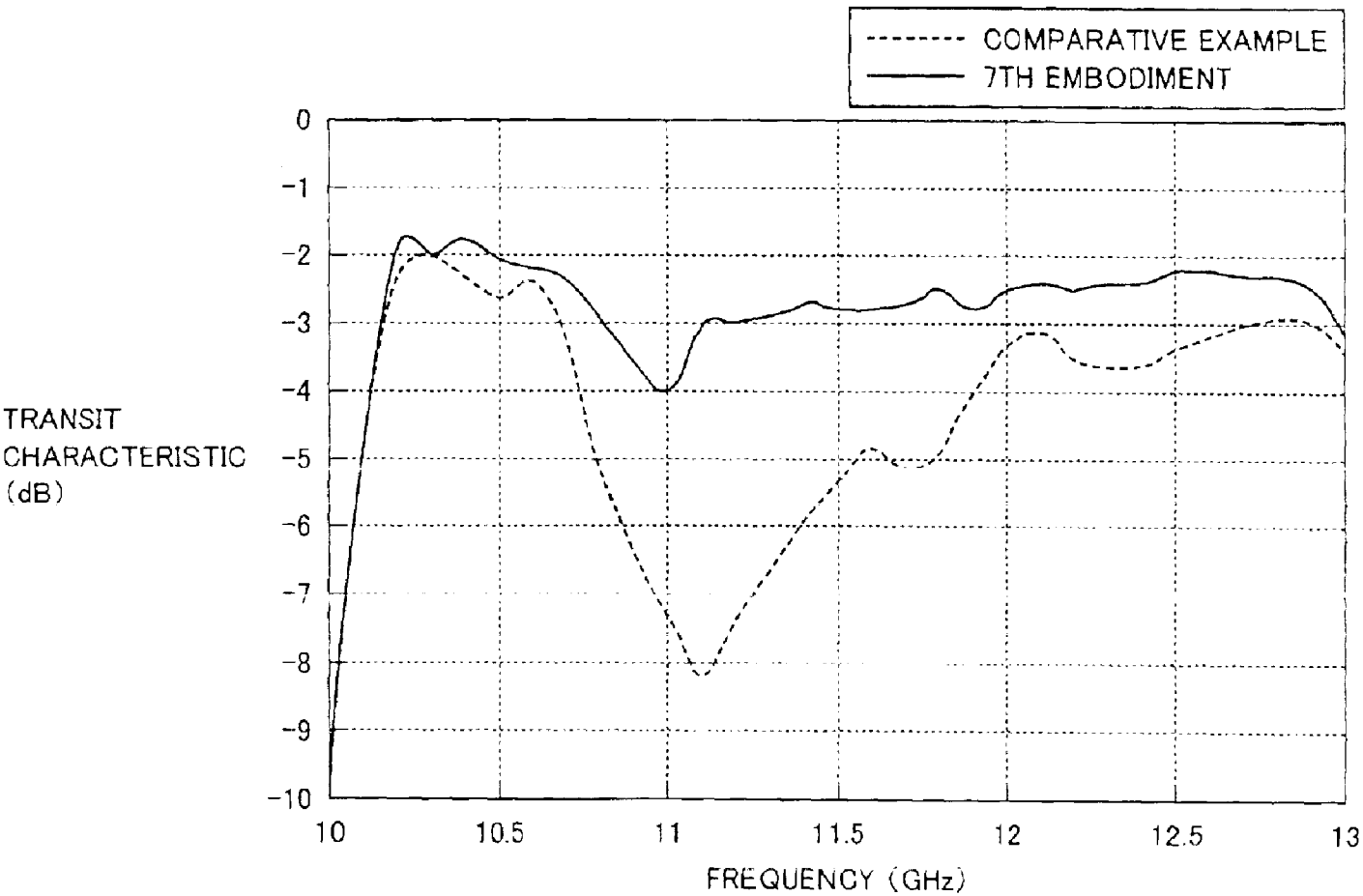
FIG. 21 represents a measurement of a transit characteristic of the LNB converter in the seventh embodiment.

FIG. 21 represents a measurement of a transit characteristic of an LNB converter employing the above described 4-layer substrate. The present embodiment exhibits a maximal deterioration of approximately −4 dB for a frequency close to 11 GHz, which, although not as good as the transit characteristic in the first embodiment, still exhibits a transit characteristic better than the third, fourth and sixth embodiments.

Eighth Embodiment

Figure 22:
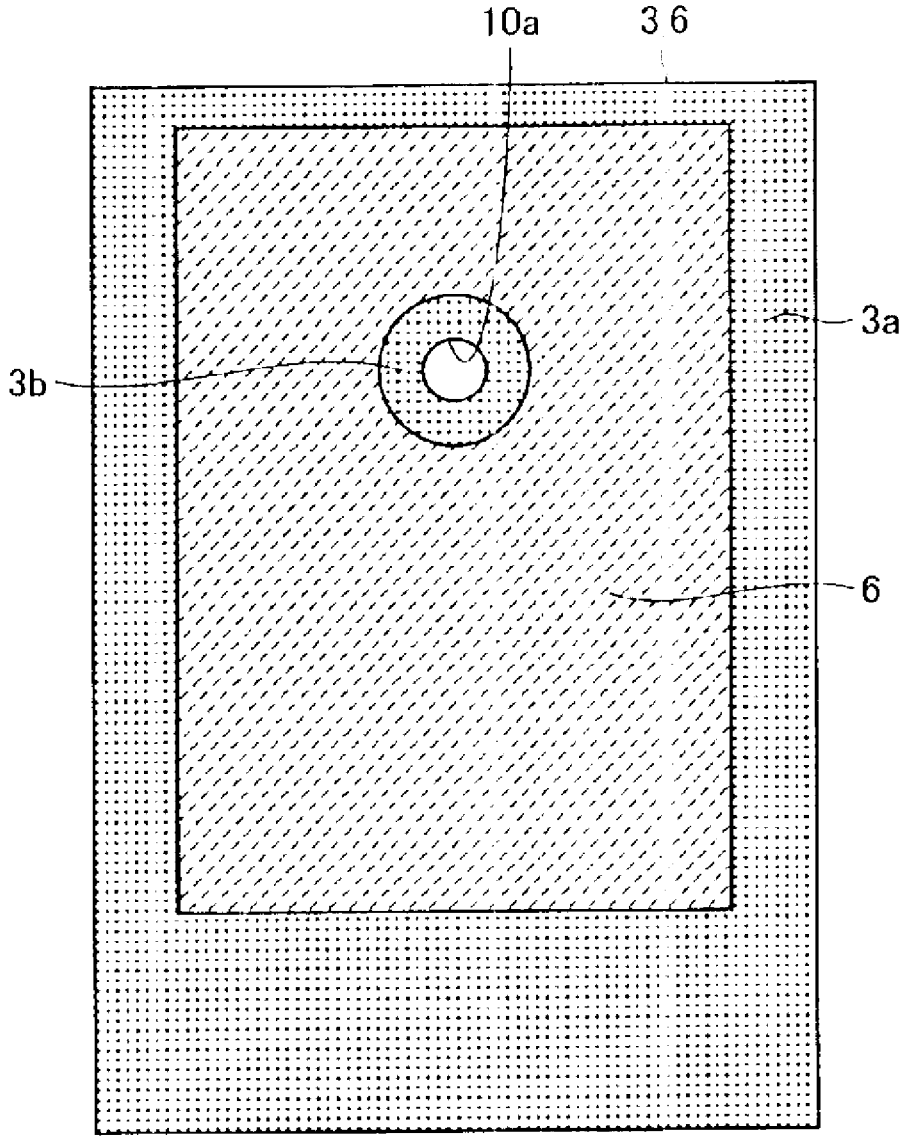
FIGS. 22 and 23 are plan views of third and fourth layers, respectively, of the 4-layer substrate used in the LNB converter of the present invention in a eighth embodiment, as seen from a pattern layer (or upward)
Figure 23:
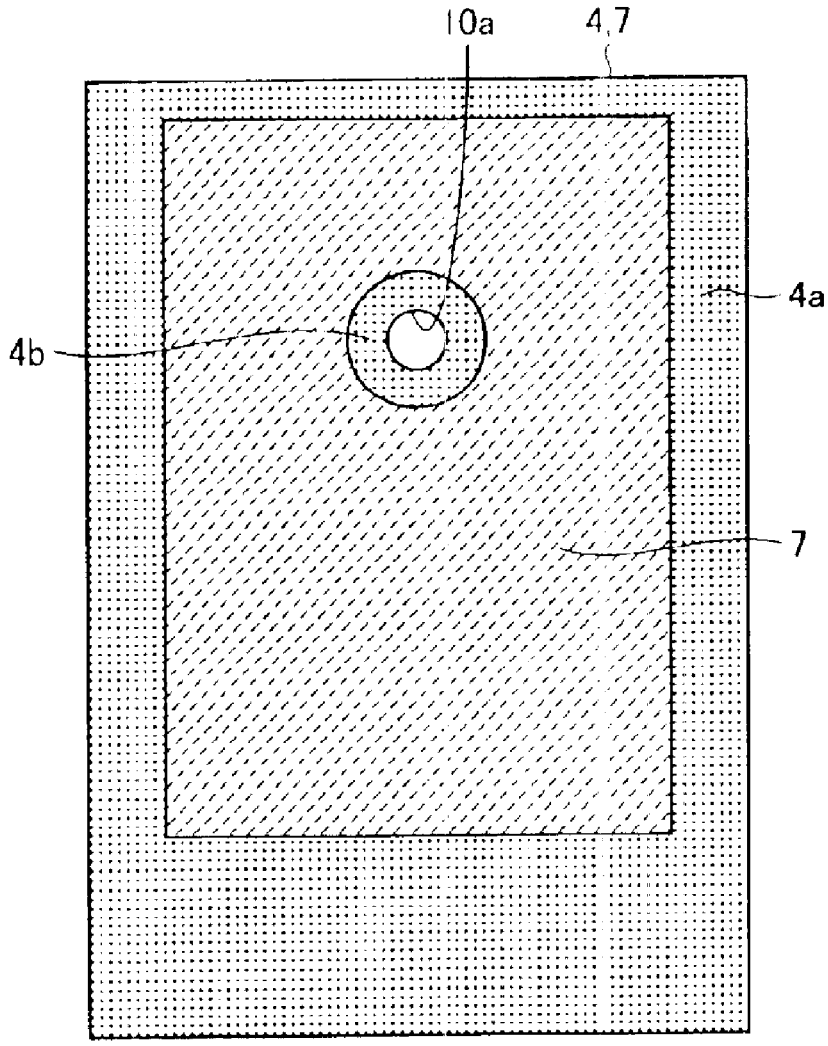

FIGS. 22 and 23 show third and fourth, pattern layers in the 4-layer substrate of the LNB converter of the present invention, and dielectric layers overlying the pattern layers, respectively. The present embodiment is characterized in that the third and fourth layers have a pattern with a ground pattern removed in a rectangle having a longer side of 9 mm and a shorter side of 7 mm, surrounding a probe and excluding probe attaching throughhole lands 3*b*, 4*b*.

By employing the 4-layer substrate thus structured a ground layer in a microstrip line provided in the first and second, pattern layers can be provided in the second, pattern layer and, as compared with the comparative example, an effect at the third and fourth, pattern layers can significantly be reduced. Thus the 4-layer substrate can be used to form an LNB converter without a transit characteristic deteriorating beyond a predetermined range.

Ninth Embodiment

Figure 24:
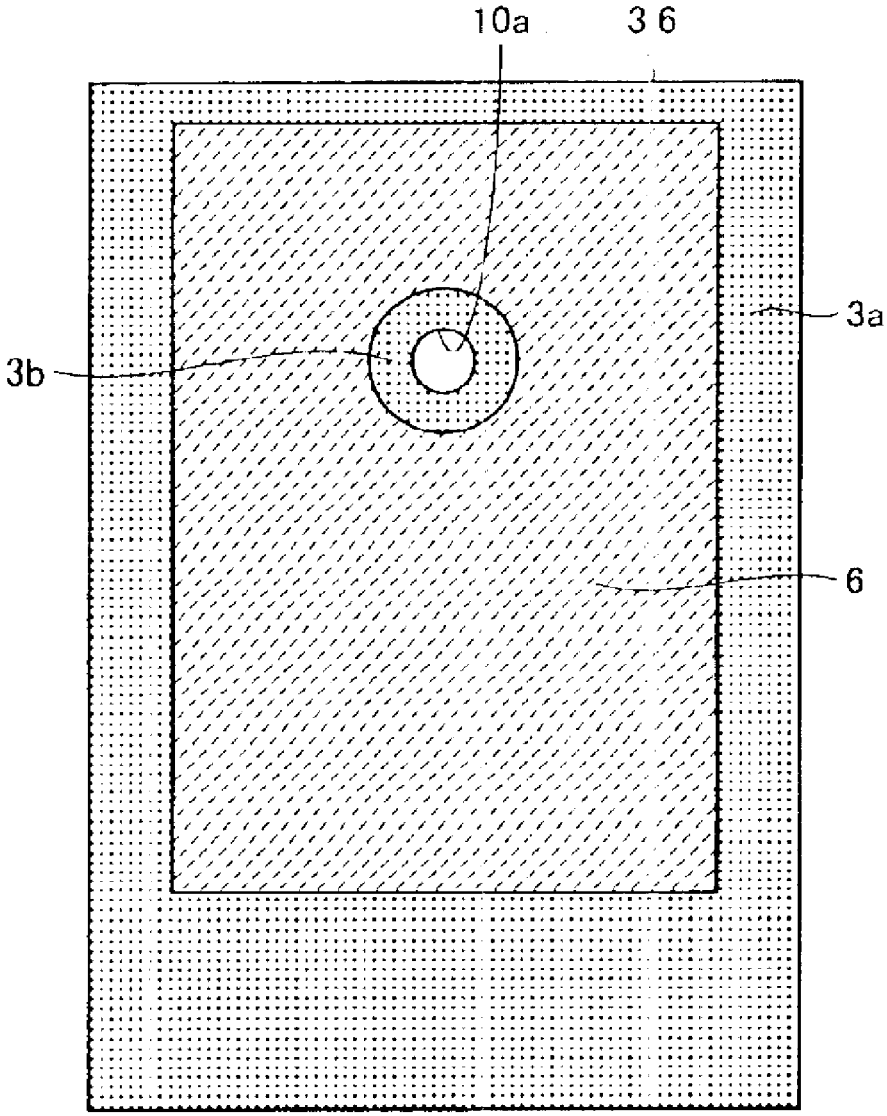
FIGS. 24 and 25 are plan views of third and fourth layers, respectively, of the 4-layer substrate used in the LNB converter of the present invention in a ninth embodiment, as seen from a pattern layer (or upward)
Figure 25:
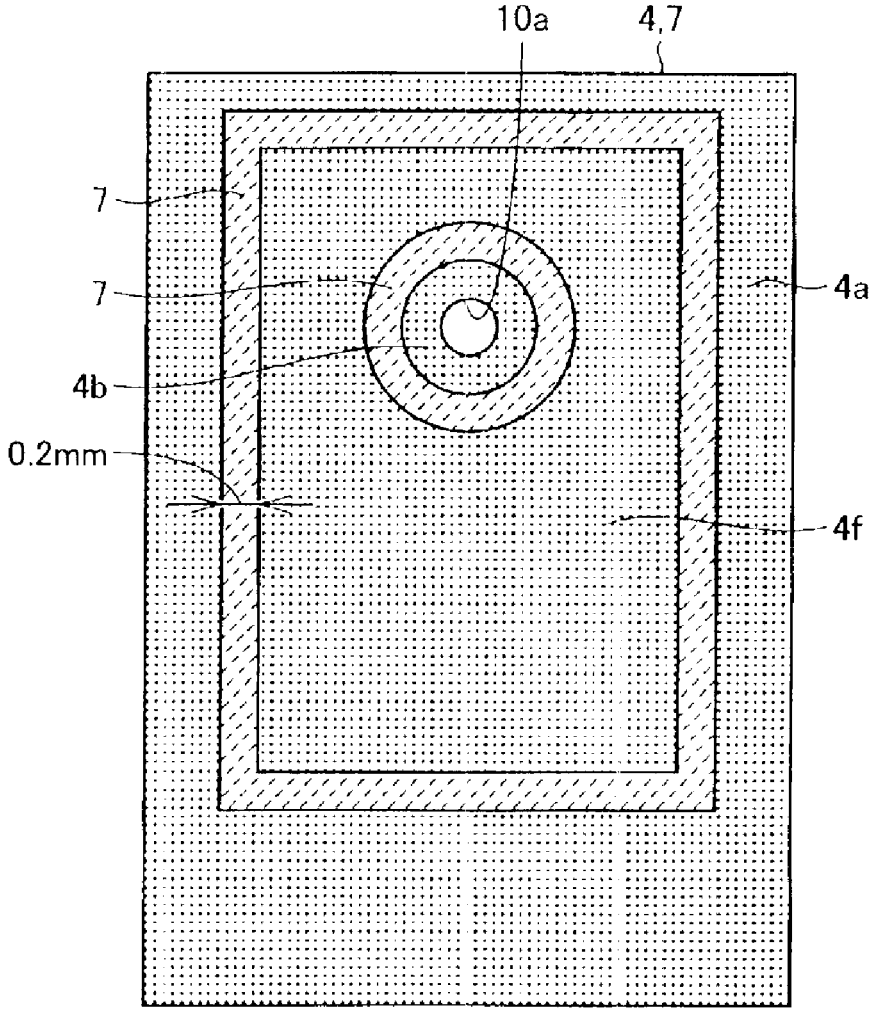

FIGS. 24 and 25 show third and fourth, pattern layers in the 4-layer substrate of the LNB converter of the present invention, and dielectric layers overlying the pattern layers, respectively. In the present embodiment, the third layer has a pattern with a ground pattern removed in a rectangle having a longer side of 9 mm and a shorter side of 7 mm, surrounding a probe and excluding a probe attaching throughhole land 4*b* and the fourth layer has a pattern surrounding the probe with a ground pattern of a rectangle (isolated region) 4*f* having a longer side of 9 mm and a shorter side of 7 mm and spaced from a surrounding ground pattern by 0.2 mm.

The 4-layer substrate thus structured, as well as those in the previous embodiments, as compared to the comparative example, can reduce an effect received at the third and fourth, pattern layers. Thus the 4-layer substrate can be used to form an LNB converter without a transit characteristic deteriorating beyond a predetermined range.

Tenth Embodiment

Figure 26:
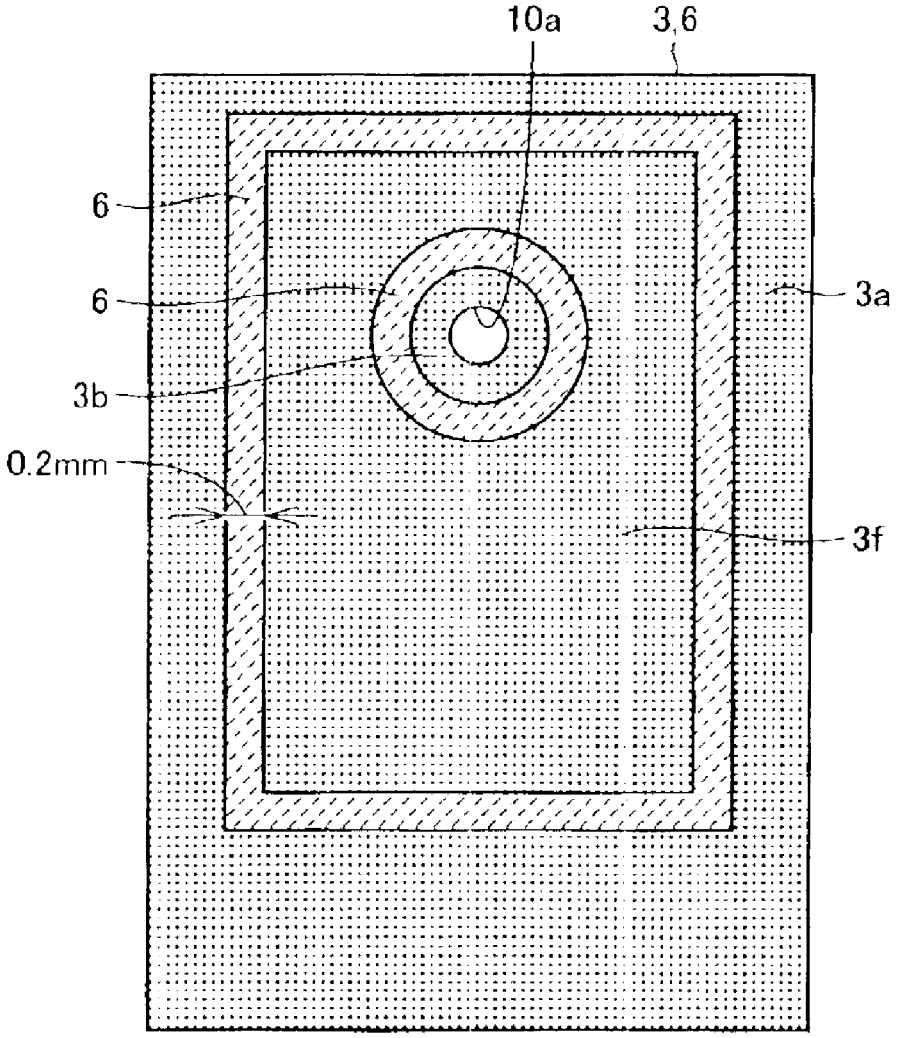
FIGS. 26 and 27 are plan views of third and fourth layers, respectively, of the 4-layer substrate used in the LNB converter of the present invention in a tenth embodiment, as seen from a pattern layer (or upward)
Figure 27:
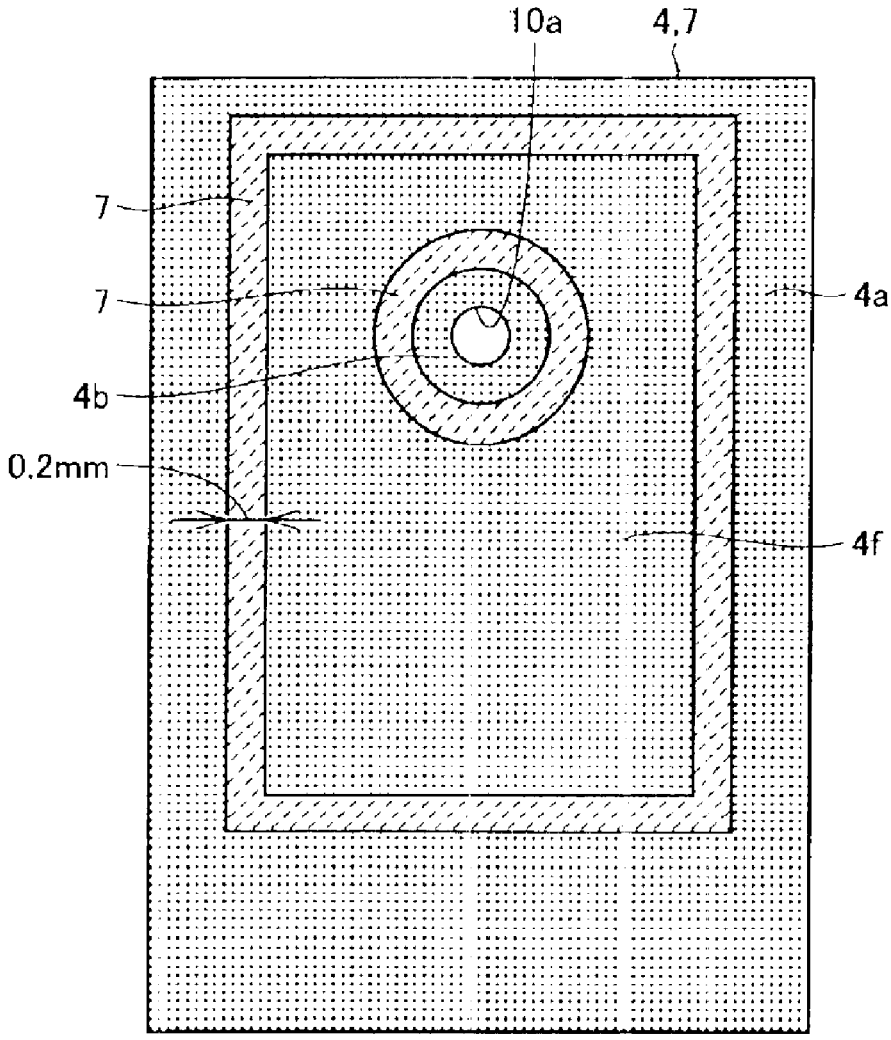

FIGS. 26 and 27 show third and fourth, pattern layers in the 4-layer substrate of the LNB converter of the present invention, and dielectric layers overlying the pattern layers, respectively. The present embodiment is characterized in that the third and fourth layers have a pattern surrounding a probe with a ground pattern of a rectangle (isolated region) 3*f*, 4*f* having a longer side of 9 mm and a shorter side of 7 mm and spaced from a surrounding ground pattern 3*a*, 4*a* by 0.2 mm.

This 4-layer substrate can also be used to form an LNB converter with a smaller effect at the third and fourth, pattern layers than in the comparative example, preventing a transit characteristic from deteriorating beyond a predetermined range.

Eleventh Embodiment

Figure 28:
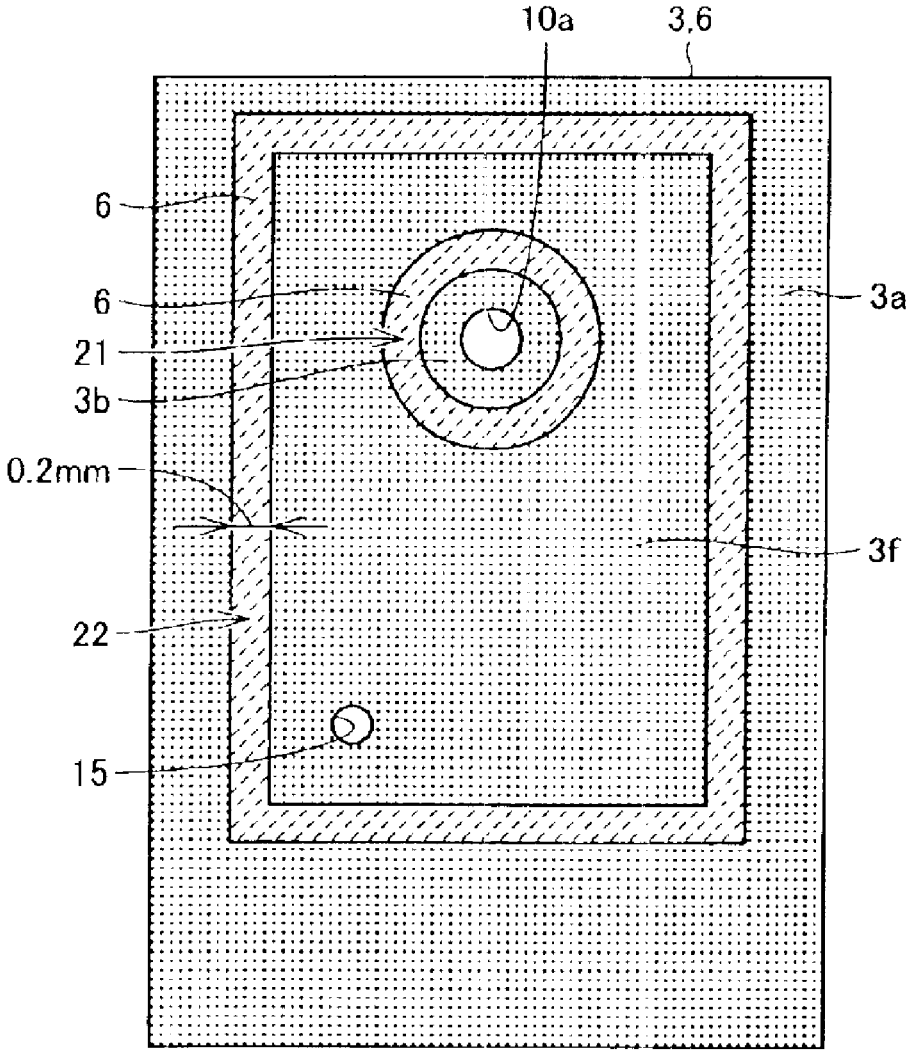
FIGS. 28 and 29 are plan views of third and fourth layers, respectively, of the 4-layer substrate used in the LNB converter of the present invention in an 11th embodiment, as seen from a pattern layer (or upward)
Figure 29:
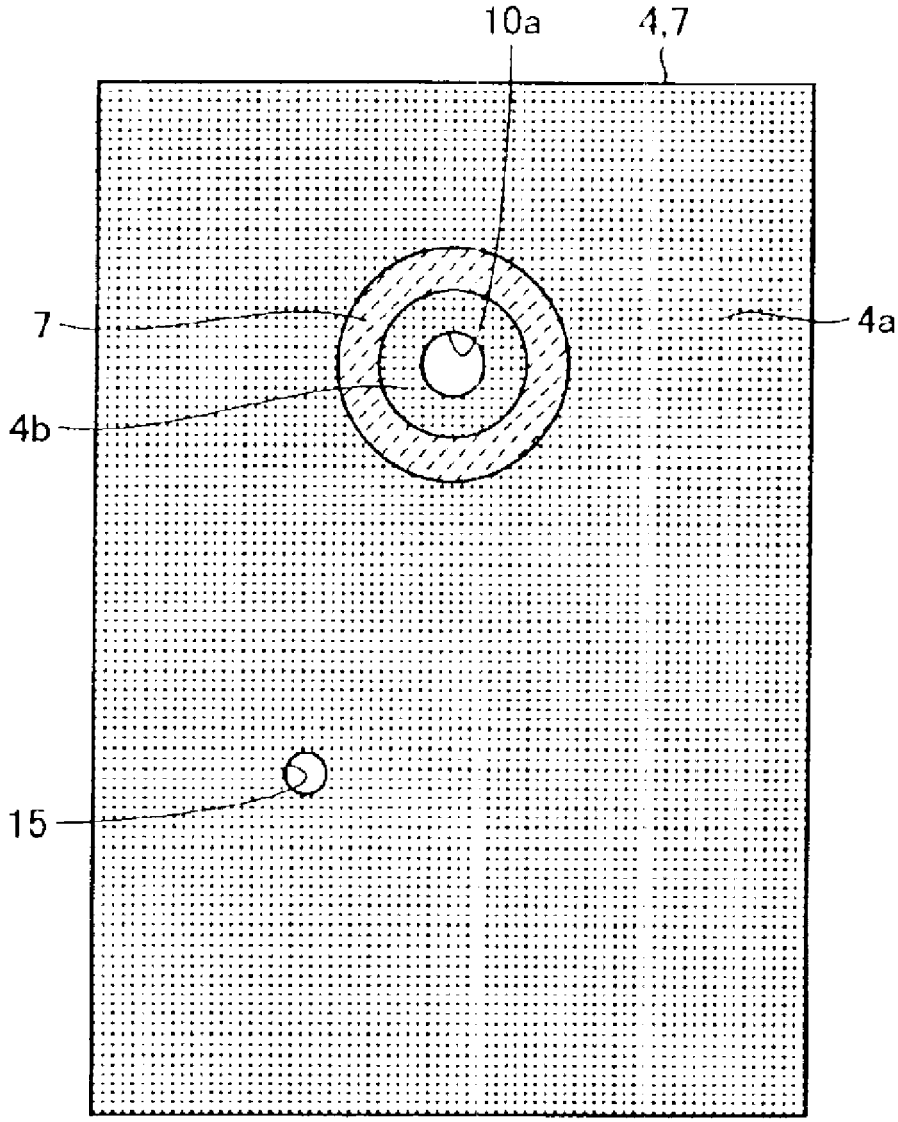

FIGS. 28 and 29 show patterns of a multilayer substrate of the present embodiment in an 11th embodiment. The patterns are both shown in a plan view, as seen upward. The third layer has a pattern surrounding a probe with a ground pattern isolated by inner and outer isolation bands 21 and 22 in a rectangle 3*f* having a longer side of 9 mm and a shorter side of 7 mm. Inner and outer isolation bands 21 and 22 each have a width of 0.2 mm. Ground pattern 4*a* in the fourth layer and isolated ground pattern 3*f* in the third layer are provided with a throughhole for conduction 15.

The present embodiment is characterized by the throughhole for conduction 15 allowing conduction of an isolated ground pattern with respect to another layer. The throughhole for conduction providing conduction with respect to another layer allows a transit characteristic equivalent to that provided when the throughhole for conduction is absent.

Twelfth Embodiment

Figure 30:
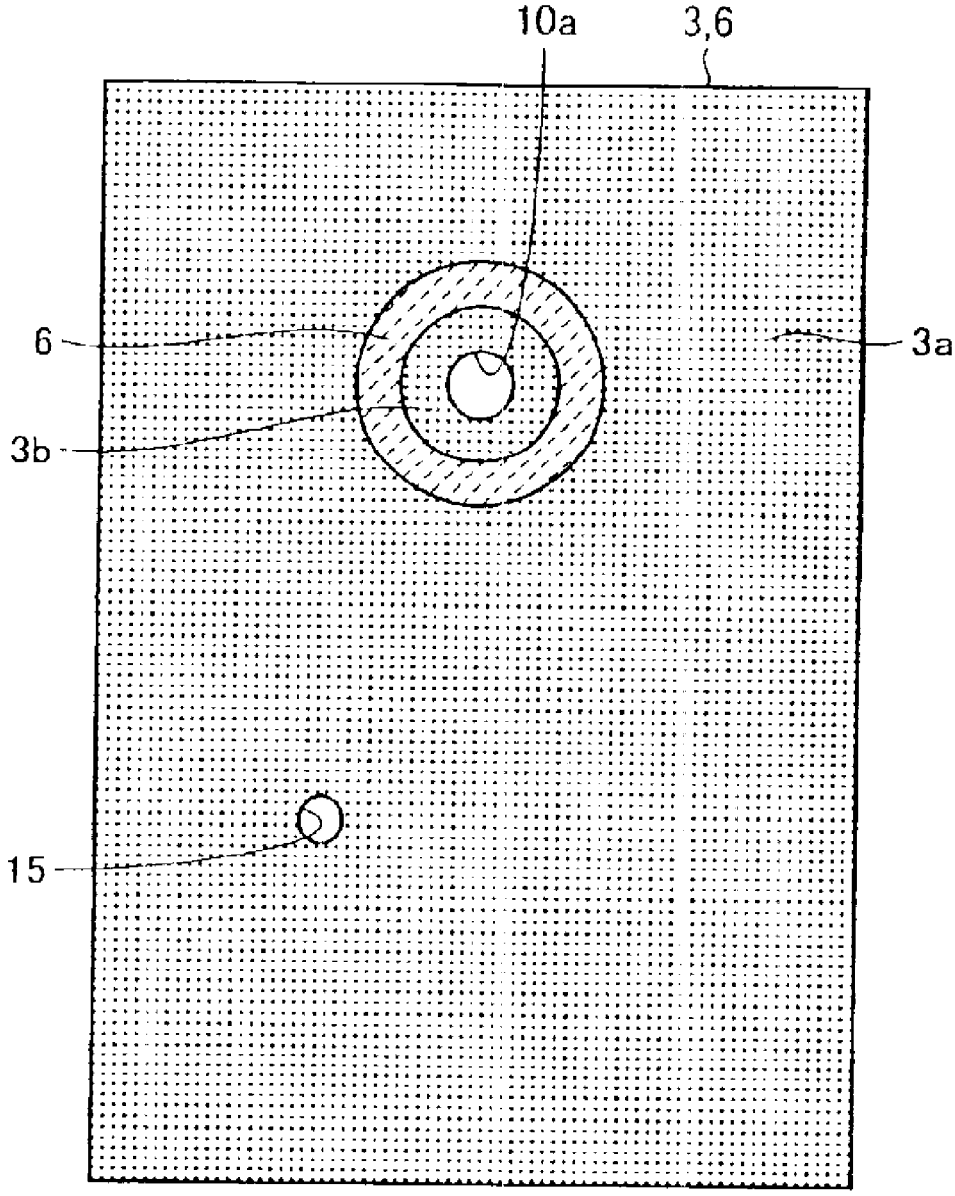
FIGS. 30 and 31 are plan views of third and fourth layers, respectively, of the 4-layer substrate used in the LNB converter of the present invention in a 12th embodiment, as seen from a pattern layer (or upward)
Figure 31:
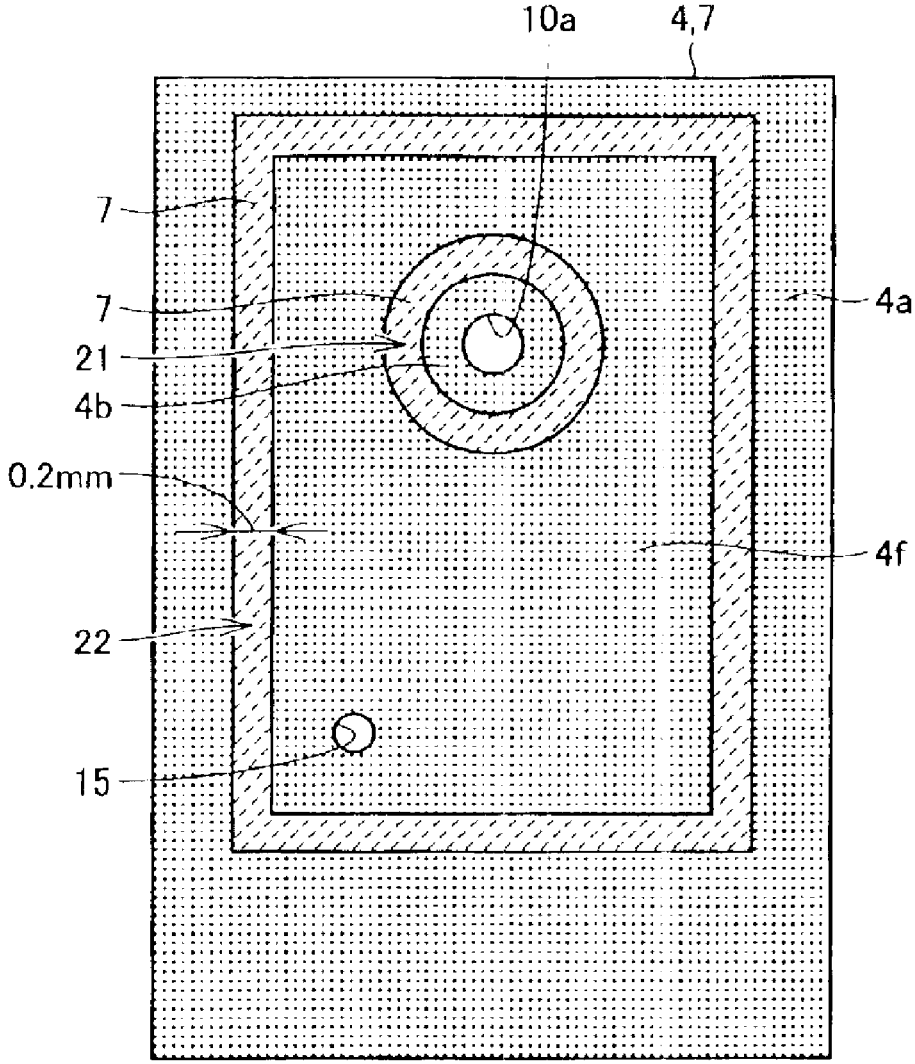
Figure 32:
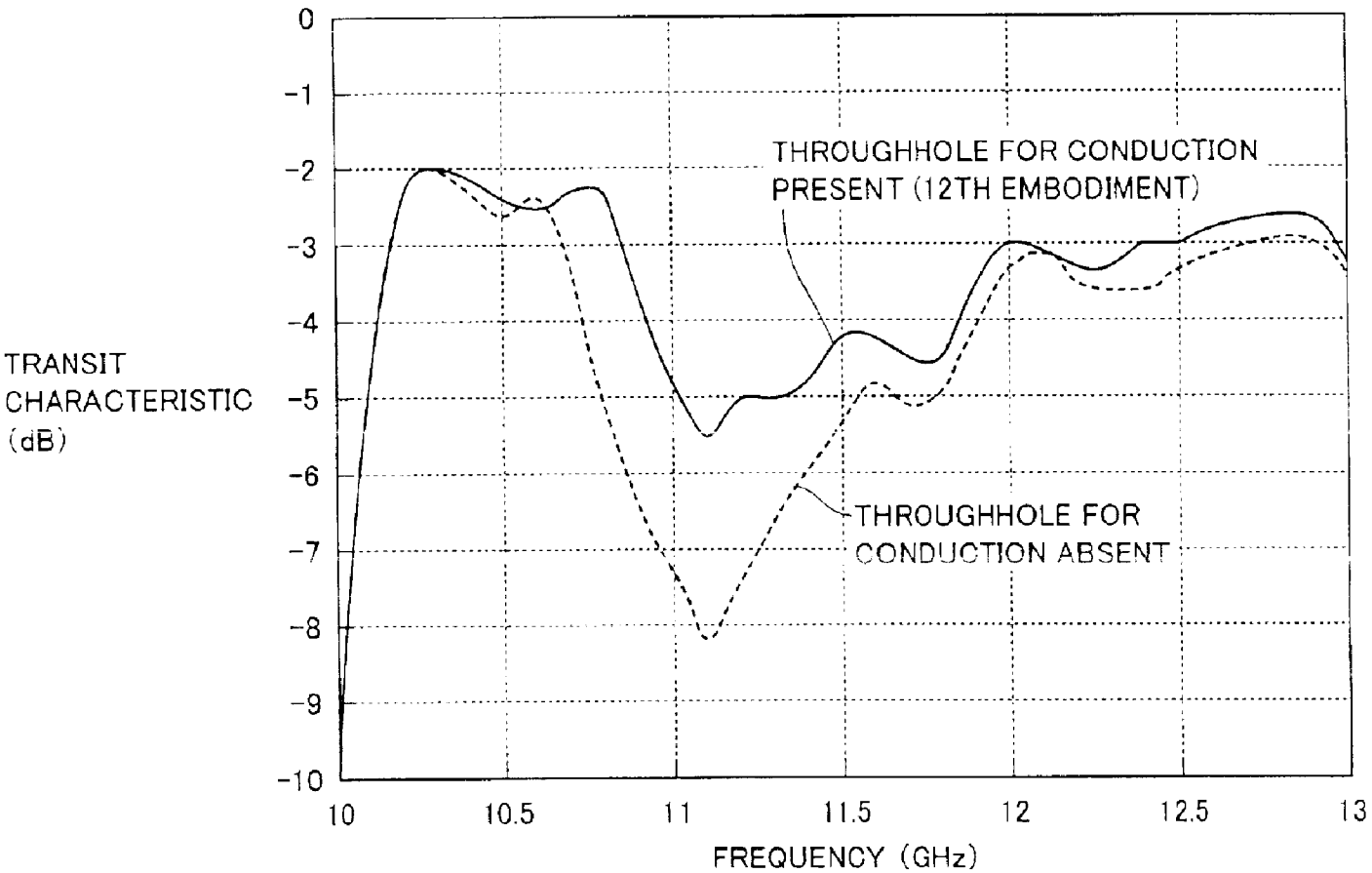
FIG. 32 represents transit characteristics of a multi-layer substrate structured as described in the 12th embodiment and a multi-layer substrate corresponding to a comparative example without a throughhole for conduction.

FIGS. 30 and 31 show a configuration of the multilayer substrate of the present invention in a 12th embodiment. As shown in FIGS. 30 and 31, the fourth layer has a pattern surrounding a probe with a ground pattern 4*a* isolated by inner and outer isolation bands 21 and 22 in a rectangle having a longer side of 9 mm and a shorter side of 7 mm. Inner and outer isolation bands 21 and 22 both have a width of 0.2 mm. Ground patterns 3*a*, 4*f* are provided with a throughhole for conduction 15.

The present embodiment is characterized by the throughhole for conduction 15 allowing conduction of an isolated ground pattern with respect to another layer. The throughhole providing conduction with respect to another layer allows a better transit characteristic than when the throughhole is absent.

Thirteenth Embodiment

Figure 33:
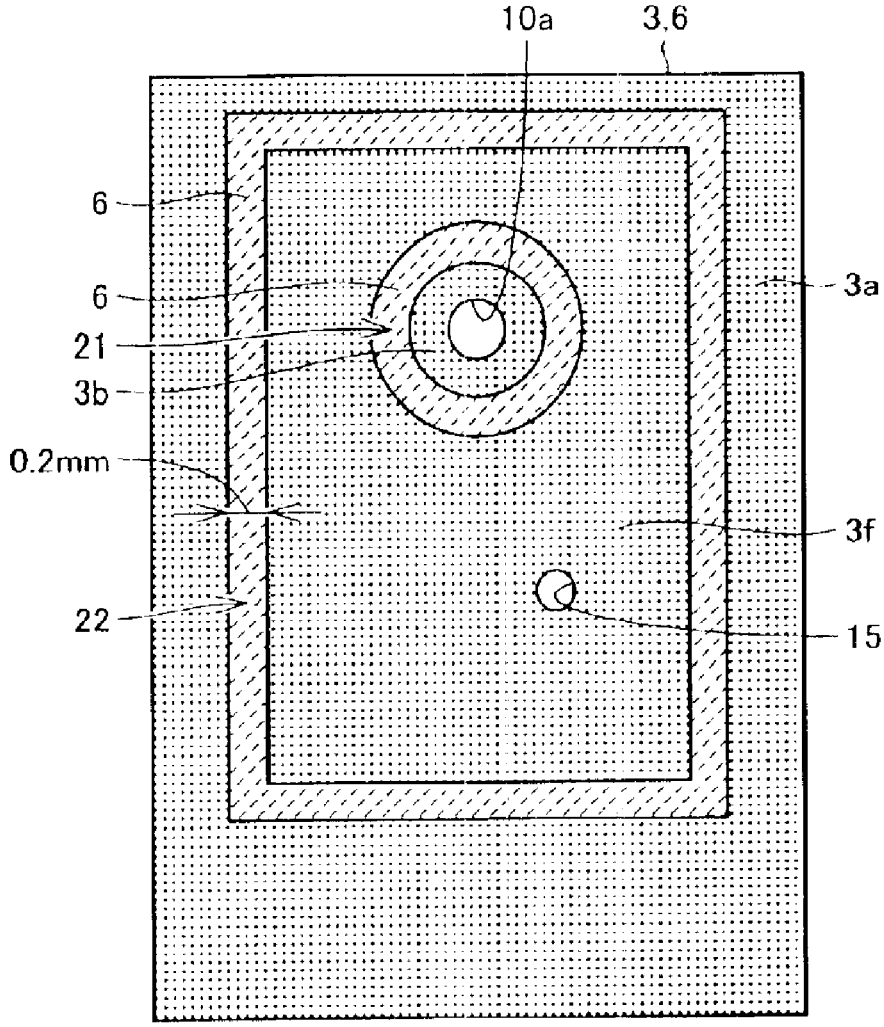
FIGS. 33 and 34 are plan views of third and fourth layers, respectively, of the 4-layer substrate used in the LNB converter of the present invention in a 13th embodiment, as seen from a pattern layer (or upward)
Figure 34:
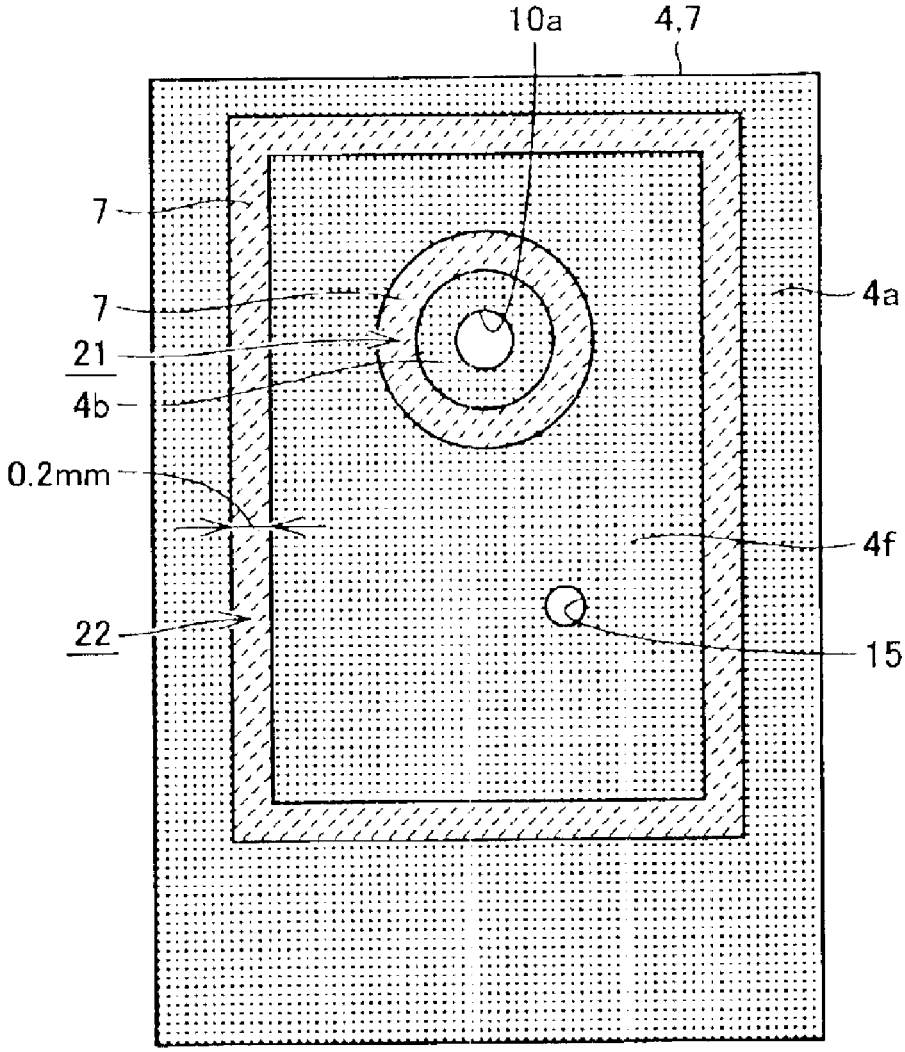

FIGS. 33 and 34 show a configuration of the multi-layer substrate of the present invention in a 13th embodiment. The third and fourth layers both have a pattern surrounding a probe hole 10*a* with ground patterns in a rectangle 3*f*, 4*f* having a longer side of 9 mm and a shorter side of 7 mm and isolated by inner and outer isolation bands 21 and 22 both having a width of 0.2 mm. Furthermore in the present embodiment the isolated ground patterns 3*f*, 4*f* have conduction with respect to the first and second layers via a throughhole for conduction 15. When throughhole 15 provides conduction with respect to the first and second layers, a transit characteristic better than in the first to tenth embodiments can be obtained.

Fourteenth Embodiment

Figure 35:
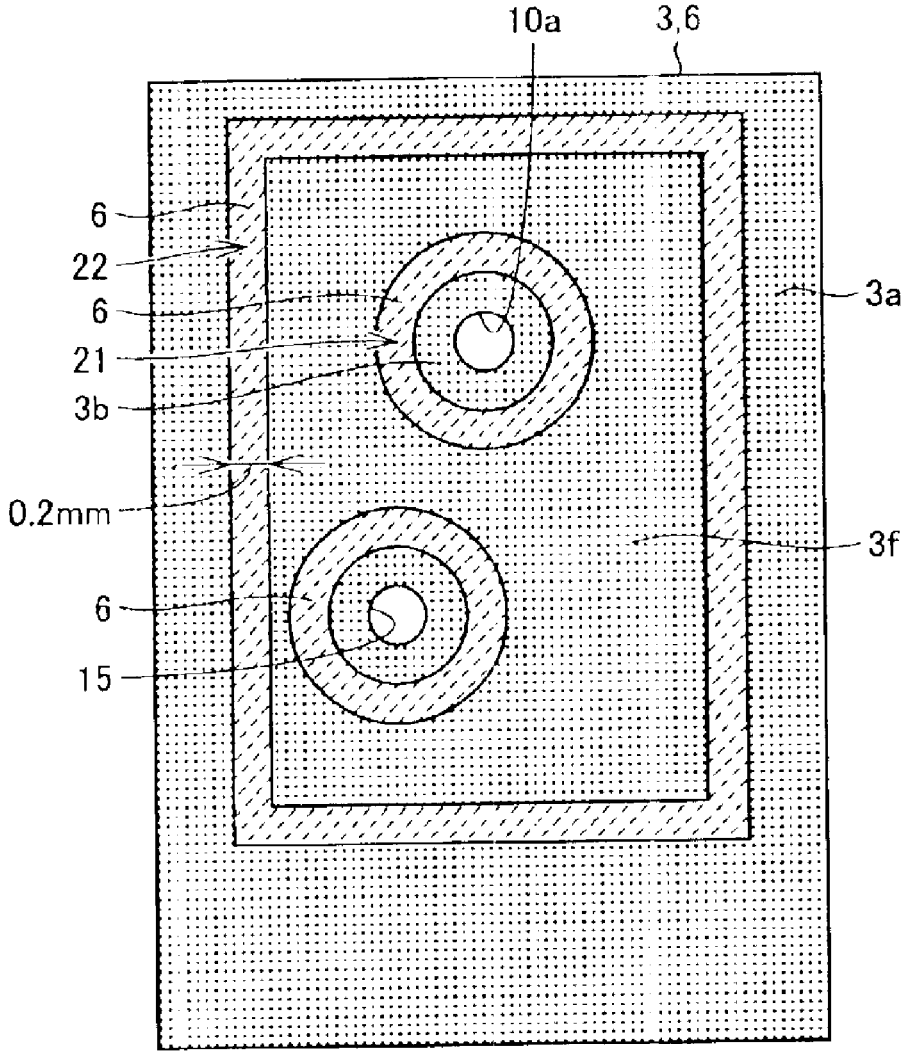
FIGS. 35 and 36 are plan views of third and fourth layers, respectively, of the 4-layer substrate used in the LNB converter of the present invention in a 14th embodiment, as seen from a pattern layer (or upward)
Figure 36:
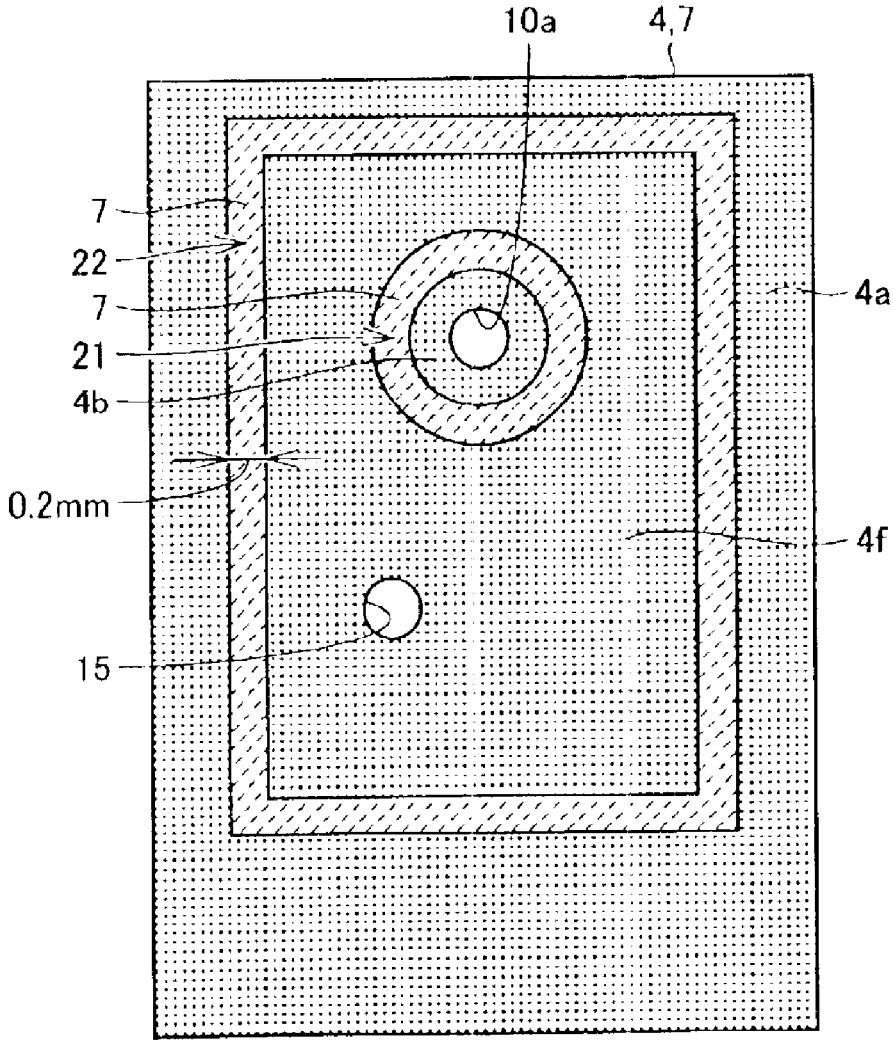

FIGS. 35 and 36 show a configuration of the multilayer substrate of the present invention in a 14th embodiment. The third and fourth layers both have a pattern 3*f*, 4*f* surrounding a probe hole 10*a* with ground patterns in a rectangle having a longer side of 9 mm and a shorter side of 7 mm and isolated by inner and outer isolation bands 21 and 22 both having a width of 0.2 mm. Furthermore in the present embodiment the fourth layer's isolated ground pattern 4*f* alone has conduction with respect to the first and second layers through a throughhole for conduction 15 and the third layer's ground pattern 3*f* does not have such conduction. This configuration can also provide better transit characteristic than the first to tenth embodiments.

Fifteenth Embodiment

Figure 37:
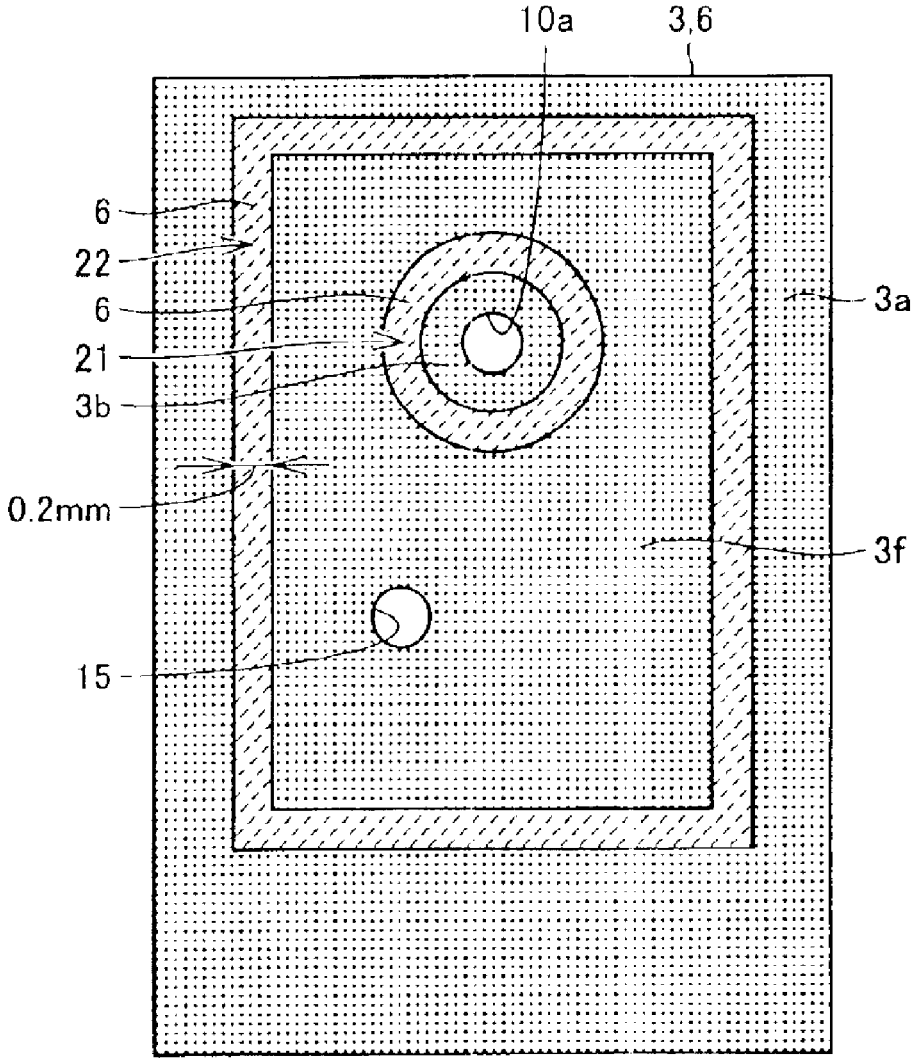
FIGS. 37 and 38 are plan views of third and fourth layers, respectively, of the 4-layer substrate used in the LNB converter of the present invention in a 15th embodiment, as seen from a pattern layer (or upward)
Figure 38:
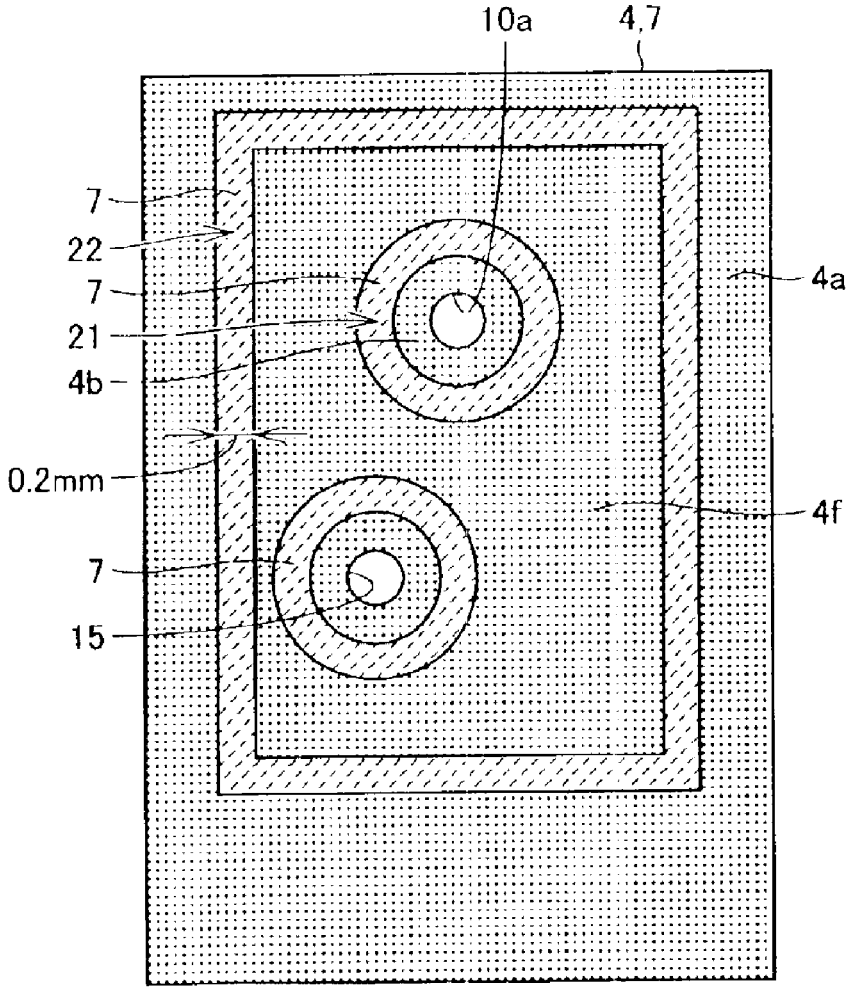

FIGS. 37 and 38 show a configuration of the multilayer substrate of the present invention in a 15th embodiment. The third and fourth layers both have a pattern surrounding a probe hole 10*a* with ground patterns in a rectangle 3*f*, 4*f* having a longer side of 9 mm and a shorter side of 7 mm and isolated by inner and outer isolation bands 21 and 22 both having a width of 0.2 mm. Furthermore in the present embodiment the third layer's isolated ground pattern 3*f* alone has conduction with respect to the first and second layers through a throughhole for conduction 15 and the fourth layer's ground pattern 4*f* does not have such conduction. This configuration can also provide better transit characteristic than the first to tenth embodiments.

Sixteenth Embodiment

Figure 39:
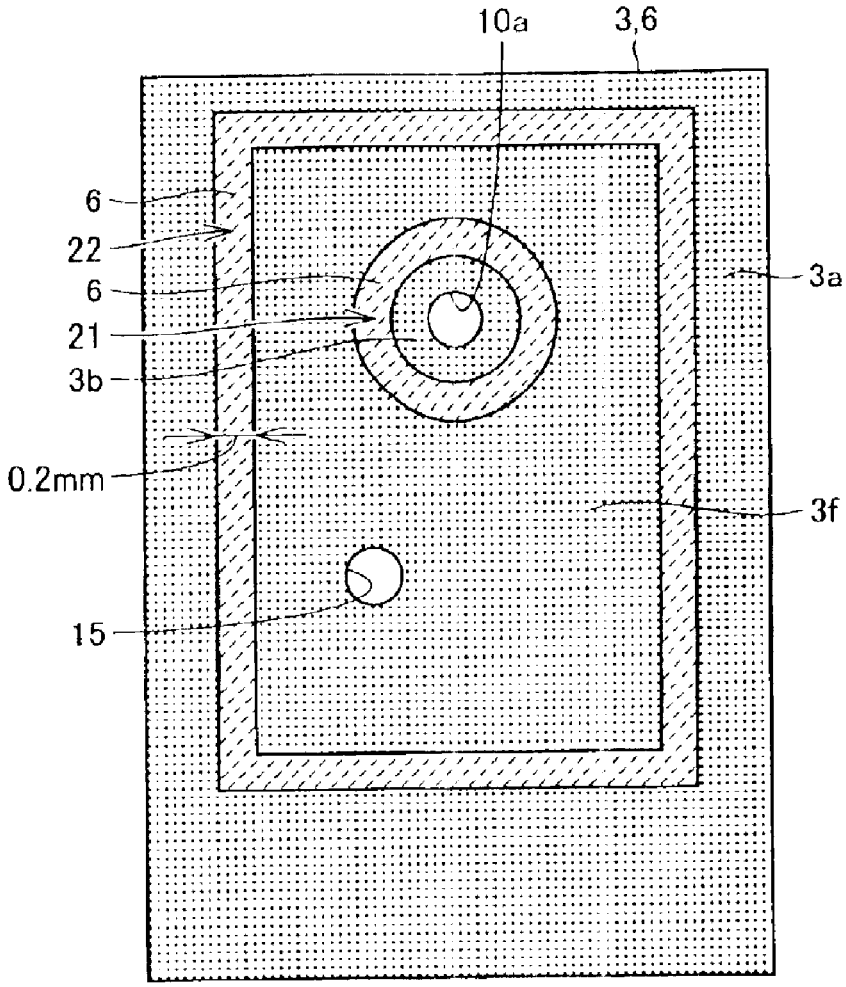
FIGS. 39 and 40 are plan views of third and fourth layers, respectively, of the 4-layer substrate used in the LNB converter of the present invention in a 16th embodiment, as seen from a pattern layer (or upward)
Figure 40:
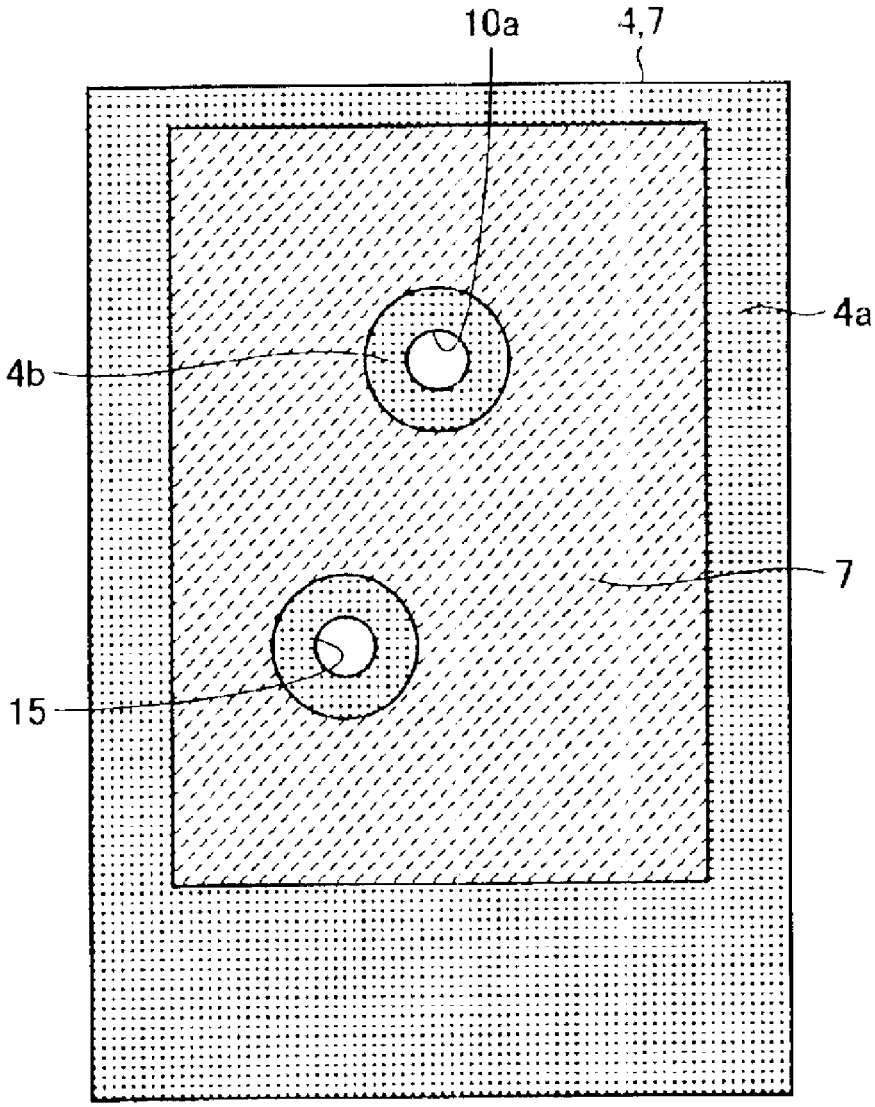

FIGS. 39 and 40 show a configuration of the multilayer substrate of the present invention in a 16th embodiment. The third layer has a pattern surrounding a probe hole 10*a* with ground pattern in a rectangle 3*f* having a longer side of 9 mm and a shorter side of 7 mm and isolated by inner and outer isolation bands 21 and 22 both having a width of 0.2 mm. Furthermore, the fourth layer has its ground pattern peeled off at a region corresponding to the third layer's ground pattern 3*f*. As such, the third layer's isolated ground pattern 3*f* alone has conduction with respect to the first and second layers through a throughhole for conduction 15 and the fourth layer's ground pattern does not have such conduction. This configuration can also provide better transit characteristic than the first to tenth embodiments.

Seventeenth Embodiment

Figure 41:
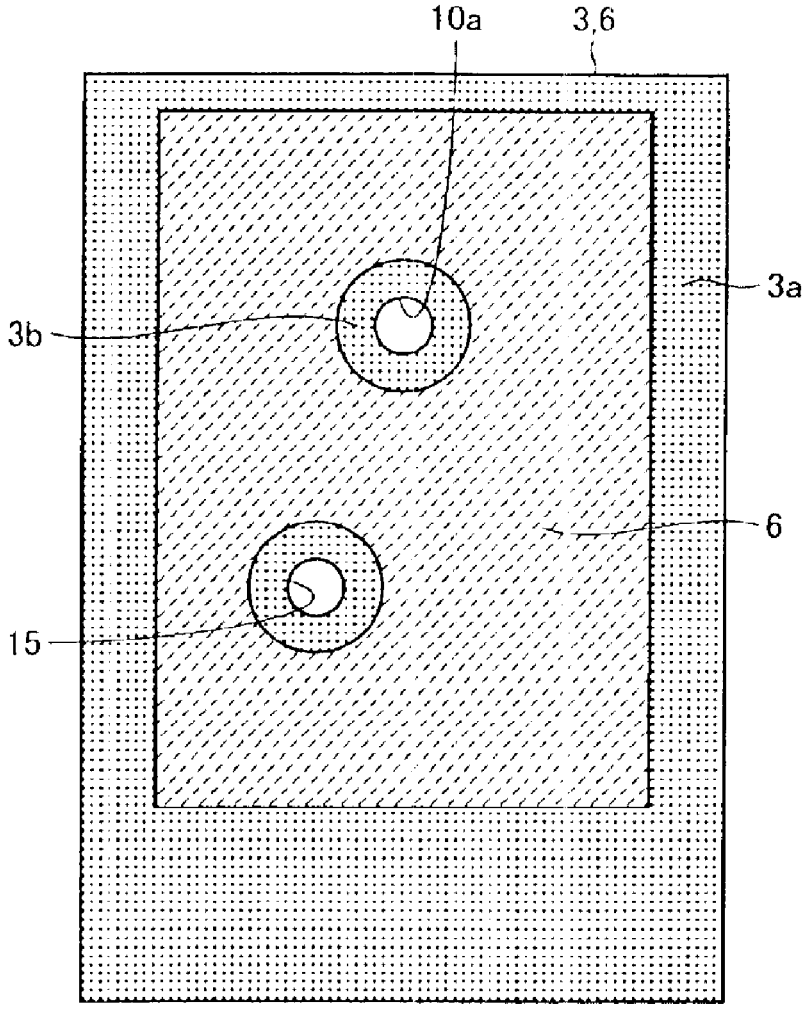
FIGS. 41 and 42 are plan views of third and fourth layers, respectively, of the 4-layer substrate used in the LNB converter of the present invention in a 17th embodiment, as seen from a pattern layer (or upward)
Figure 42:
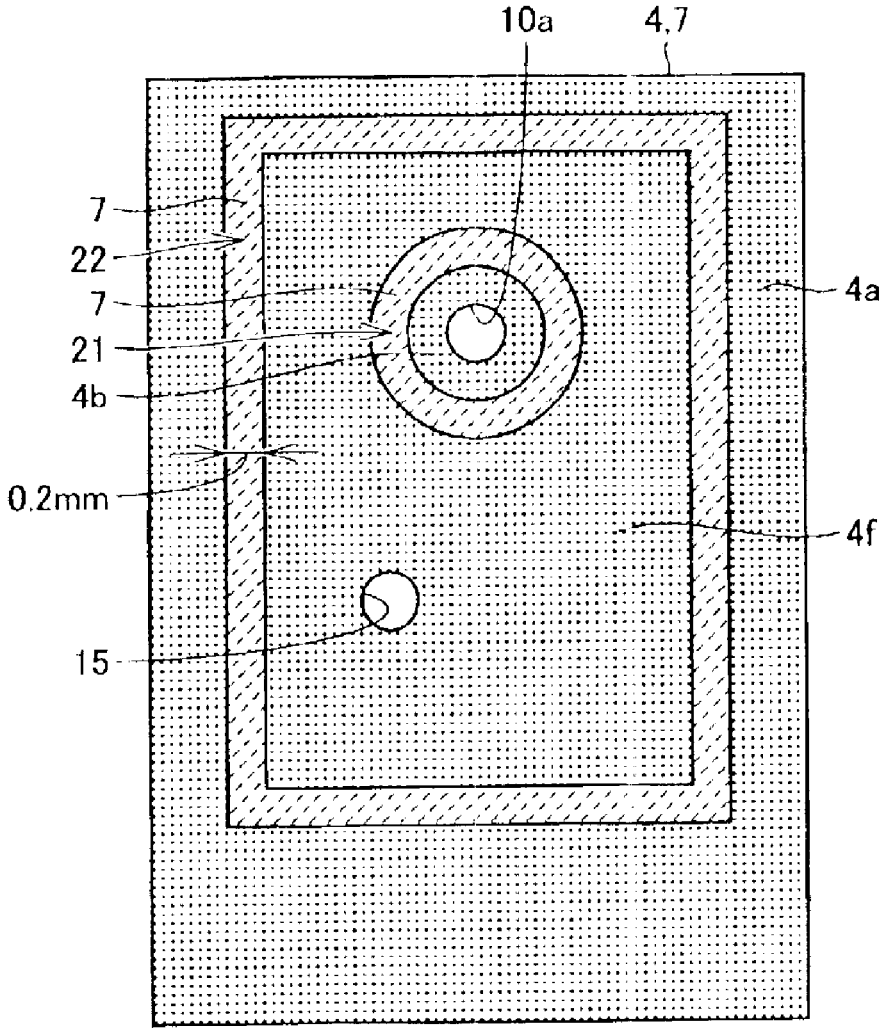
Figure 43:
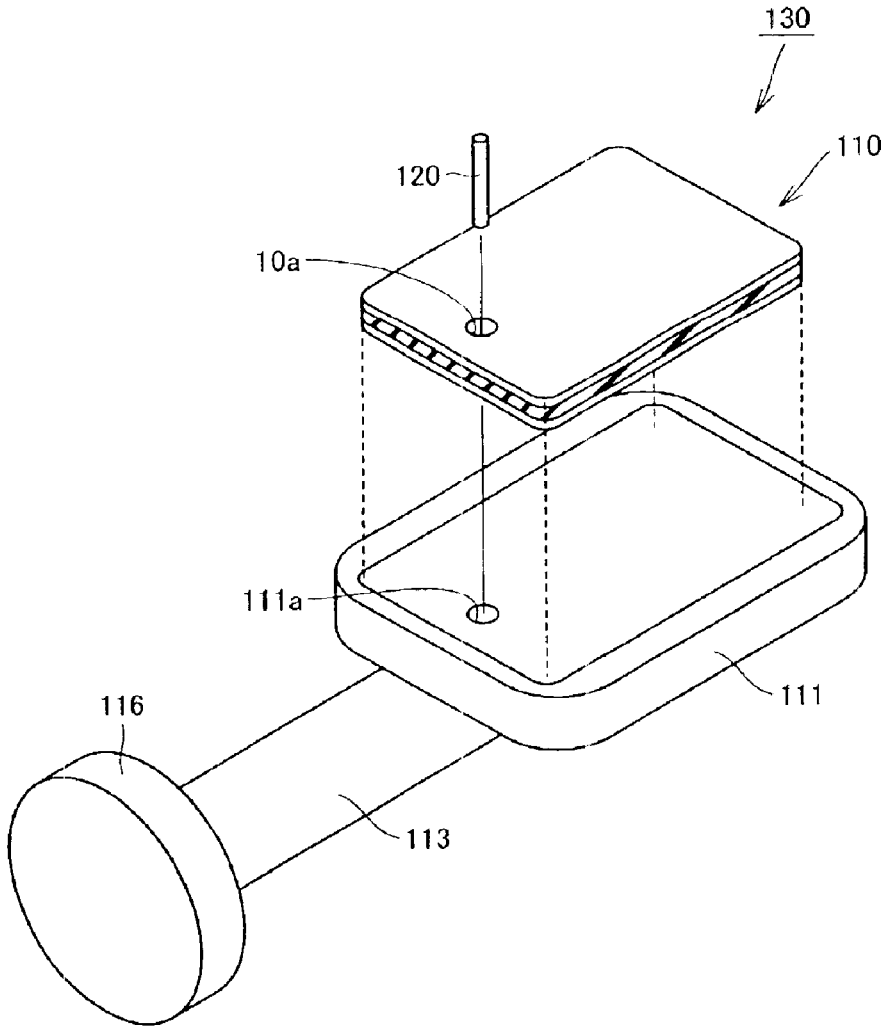
FIG.43 PRIOR ART
FIG. 43 is an exploded perspective view of a conventional LNB converter.
Figure 44:
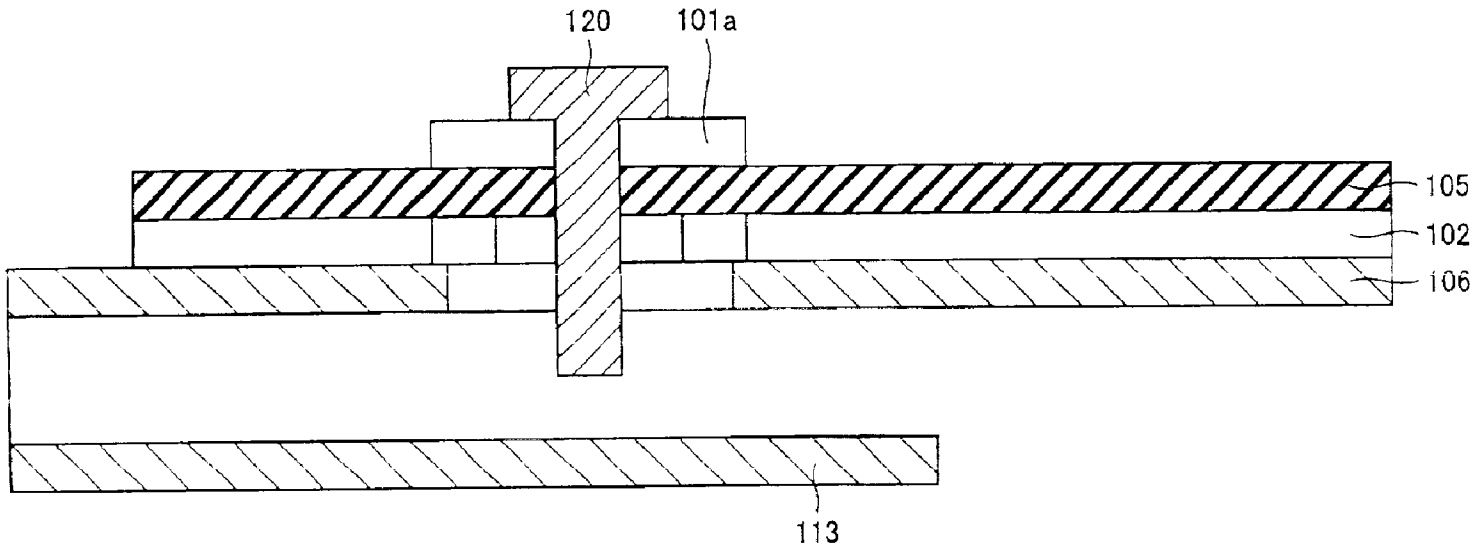
FIG.44 PRIOR ART
FIG. 44 is a cross section of a conventional LNB converter with a double-sided substrate arranged.
Figure 45:
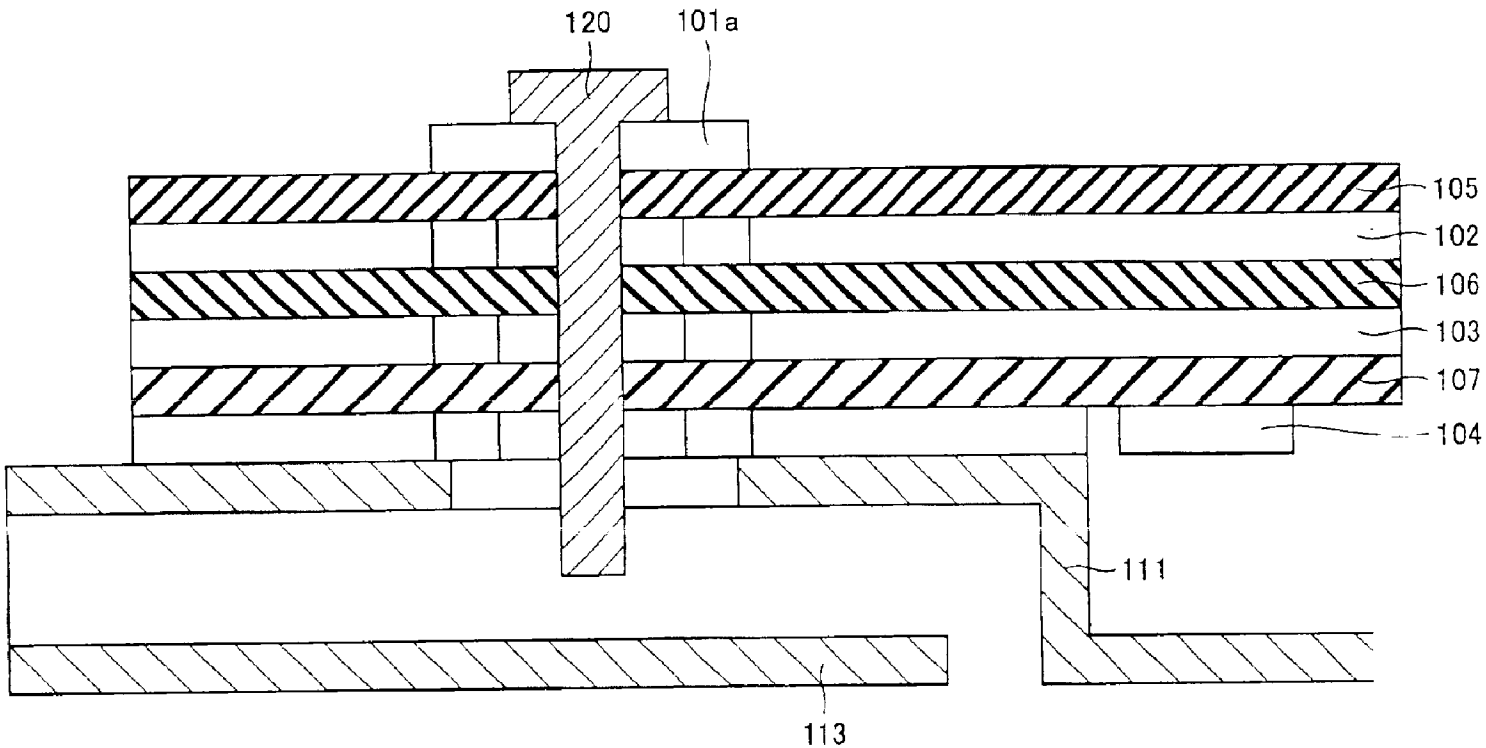
FIG.45 PRIOR ART
FIG. 45 is a cross section of a conventional LNB converter with a 4-layer substrate arranged.

FIGS. 41 and 42 show a configuration of the multilayer substrate of the present invention in a 17th embodiment. The fourth layer has a pattern surrounding a probe hole 10*a* with ground pattern in a rectangle 4*f* having a longer side of 9 mm and a shorter side of 7 mm and isolated by inner and outer isolation bands 21 and 22 both having a width of 0.2 mm. Furthermore, the third layer has its ground pattern peeled off at a region corresponding to the fourth layer's ground pattern 4*f*. As such, the fourth flayer's isolated ground pattern 4*f* alone has conduction with respect to the first and second layers through a throughhole for conduction 15 and the third layer's ground pattern does not have such conduction. This configuration can also provide better transit characteristic than the first to tenth embodiments.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A satellite broadcast reception apparatus comprising a multilayer substrate provided with a microstrip line and including more than two pattern layers sandwiching a dielectric layer, the apparatus receiving an electric wave signal from an antenna, passing the signal through a waveguide and transmitting the signal via a probe to said microstrip line, wherein:

said microstrip line is formed at one surface layer's pattern a second layer's pattern cooperating with said one surface layer's pattern to sandwich a dielectric layer underlying said one surface layer's pattern and said probe is inserted from said one surface layer's pattern into a probe hole extending in a direction intersecting said multilayer substrate to pass said probe; and in at least one pattern layer other than said first and second, pattern layers at least a region surrounding said probe hole is one of a pattern free region provided by removing a predetermined region surrounding said probe hole and an isolated region corresponding to a predetermined region surrounding said probe hole and electrically isolated from an outer, surrounding region of said at least one pattern layer.

2. The apparatus of claim 1, wherein the pattern layer provided with one of said pattern free region and said isolated region underlies a dielectric layer having a dielectric free region provided by removing a predetermined region surrounding said prove hole.

3. The apparatus of claim 1, wherein in any pattern layer other than said first and second, pattern layers a region corresponding to said probe hole and a region surrounding said probe hole as well as the dielectric layer overlying the pattern layer and corresponding to said regions are removed to provide an open region.

4. The apparatus of claim 1, wherein when said multilayer substrate is a 4-layer substrate, in both of said third and fourth layers a region corresponding to said probe hole and a region surrounding said probe hole as well as the dielectric layer overlying said third and fourth, pattern layers and corresponding to said regions are removed to provide an open region.

5. The apparatus of claim 1, wherein when said multilayer substrate is a 4-layer substrate, said fourth, pattern layer includes an isolated region surrounding said probe hole and further electrically isolated from an outer region of the pattern layer.

6. The apparatus of claim 1, wherein when said multilayer substrate is a 4-layer substrate, said fourth, pattern layer has a patterned portion removed to provide a pattern free region surrounding said probe hole.

7. The apparatus of claim 1, wherein when said multilayer substrate is a 4-layer substrate, said third, pattern layer includes an isolated region surrounding said probe hole and further electrically isolated from an outer region of the pattern layer.

8. The apparatus of claim 1, wherein when said multilayer substrate is a 4-layer substrate, said third, pattern layer has a patterned portion removed to provide a pattern free region surrounding said probe hole.

9. The apparatus of claim 1, wherein when said multilayer substrate is a 4-layer substrate, said third, pattern layer includes an isolated region surrounding said probe hole and further electrically isolated from an outer region of the pattern layer and said fourth, pattern layer has a patterned portion removed to provide a pattern free region surrounding said probe hole.

10. The apparatus of claim 1, wherein when said multilayer substrate is a 4-layer substrate said third and fourth, pattern layers both have a patterned portion removed to provide a pattern free region surrounding said probe hole.

11. The apparatus of claim 1, wherein when said multilayer substrate is a 4-layer substrate said third, pattern layer has a patterned portion removed to provide a pattern free region surrounding said probe hole and said fourth, pattern layer includes an isolated region surrounding said probe hole and further electrically isolated from an outer region of the pattern layer.

12. The apparatus of claim 1, wherein when said multilayer substrate is a 4-layer substrate said third and fourth, pattern layers both have an isolated region surrounding said probe hole and further electrically isolated from an outer region of the pattern layers.

13. The apparatus of claim 1, wherein:

a throughhole land exposed to said probe hole to surround said probe hole for attaching said probe is provided;

said pattern free region or said isolated region is provided outer than it to surround said throughhole land; and said isolated region is electrically isolated from said throughhole land.

14. A satellite broadcast reception apparatus comprising a multilayer substrate provided with a microstrip line and including more than two pattern layers sandwiching a dielectric layer, the apparatus receiving an electric wave signal from an antenna, passing the signal through a waveguide and transmitting the signal via a probe to said microstrip line, wherein:

said microstrip line is formed at one surface layer's pattern a second layer's pattern cooperating with said one surface layer's pattern to sandwich a dielectric layer underlying said one surface layer's pattern and said probe is inserted from said one surface layer's pattern into a probe hole extending in a direction intersecting said multilayer substrate to pass said probe; and in at least one dielectric layer overlying a pattern layer other than said first and second, pattern layers at least a region surrounding said probe hole is a dielectric free region provided by removing a predetermined region surrounding said probe hole.

15. The apparatus of claim 14, wherein when said multilayer substrate is a 4-layer substrate any of said third and fourth, pattern layers underlies a dielectric layer having a portion removed to provide a dielectric free region surrounding said probe hole.

16. The apparatus of claim 14, wherein:

a throughhole land exposed to said probe hole to surround said probe hole for attaching said probe is provided; and said dielectric free region is provided outer than it to surround said throughhole land.

17. A satellite broadcast reception apparatus comprising a multilayer substrate provided with a microstrip line and including four, microstrip's pattern layers sandwiching a dielectric layer, the apparatus receiving an electric wave signal from an antenna, passing the signal through a waveguide and transmitting the signal via a probe to said microstrip line, wherein:

said microstrip line is formed at one surface layer's pattern a second layer's pattern cooperating with said one surface layer's pattern to sandwich a dielectric layer underlying said one surface layer's pattern and said probe is inserted from said one surface layer's pattern into a probe hole extending in a direction intersecting said multilayer substrate to pass said probe; and at least one of said third and fourth layer has a pattern with a ground pattern surrounding said probe and isolated by an inner isolation band corresponding to a pattern free portion in a band surrounding a throughhole land passing said probe and by an outer isolation band corresponding to a pattern free portion in a band located outer than said inner isolation band and surrounding said ground pattern, the isolated ground pattern having conduction with respect to another layer through a throughhole extending through the ground pattern for conduction.

18. The apparatus of claim 17, wherein said third layer includes a ground pattern surrounding said probe and isolated by said inner and outer isolation bands and the isolated ground pattern is penetrated by said throughhole for conduction.

19. The apparatus of claim 17, wherein said fourth layer includes a ground pattern surrounding said probe and isolated by said inner and outer isolation bands and the isolated ground pattern is penetrated by said throughhole for conduction.

20. The apparatus of claim 17, wherein said third and fourth layers include a ground pattern surrounding said probe and isolated by said inner and outer isolation bands and said third and fourth layers' isolated ground pattern is penetrated by said throughhole for conduction.

21. The apparatus of claim 17, wherein said third and fourth layers include a ground pattern surrounding said probe and isolated by said inner and outer isolation bands and said fourth layer's isolated pattern has conduction with respect to a layer other than said third layer through said throughhole for conduction.

22. The apparatus of claim 17, wherein said third and fourth layers include a ground pattern surrounding said probe and isolated by said inner and outer isolation bands and said third layer's isolated pattern has conduction with respect to a layer other than said fourth layer through said throughhole for conduction.

23. The apparatus of claim 17, wherein said third layer includes a ground pattern surrounding said probe and isolated by said inner and outer isolation bands, said fourth layer has a ground pattern surrounding said probe and having peeled off a region surrounding said throughhole land, and said third layer's isolated pattern has conduction with respect to a layer other than said fourth layer through said throughhole for conduction.

24. The apparatus of claim 17, wherein said third layer has a ground pattern surrounding said probe and having peeled off a region surrounding said throughhole land, said fourth layer includes a ground pattern surrounding said probe and isolated by said inner and outer isolation bands, and said fourth layer's isolated pattern has conduction with respect to a layer other than said third layer through said throughhole for conduction.

25. A multilayer substrate provided with a microstrip line, having more than two pattern layers with a dielectric layer posed therebetween, and provided with a probe hole passing a probe therethrough, wherein:

said microstrip line is provided at one surface layer's pattern and a second layer's pattern cooperating with said one surface layer's pattern to sandwich a dielectric layer; and in at least one pattern layer other than said first and second, pattern layers at least a region surrounding said probe hole is one of a pattern free region provided by removing a predetermined region surrounding said probe hole and an isolated region corresponding to a predetermined region surrounding said probe hole and further electrically isolated from an outer, surrounding region of said at least one pattern layer.

26. The multilayer substrate of claim 25, wherein one of said pattern free region and said isolated region underlies a dielectric layer having a dielectric free region provided by removing a region surrounding said prove hole.

27. The multilayer substrate of claim 25, wherein in any pattern layer other than said first and second, pattern layers a region corresponding to said probe hole and a region surrounding said probe hole as well as any dielectric layer overlying the pattern layer and corresponding to said regions are removed to provide an open region.

28. The multilayer substrate of claim 25, wherein:

a throughhole land exposed to said probe hole to surround said probe hole for attaching said probe is provided;

said pattern free region or said isolated region is provided outer than it to surround said throughhole land; and said isolated region is electrically isolated from said throughhole land.

29. A multilayer substrate provided with a microstrip line, having more than two pattern layers with a dielectric layer posed therebetween, and provided with a probe hole passing a probe therethrough, wherein:

said microstrip line is provided at one surface layer's pattern and a second layer's pattern cooperating with said one surface layer's pattern to sandwich a dielectric layer; and in at least one dielectric layer overlying a pattern layer other than said first and second, pattern layers at least a region surrounding said probe hole is a dielectric free region provided by removing a predetermined region surrounding said probe hole.

30. The multilayer substrate of claim 29, wherein:

a throughhole land exposed to said probe hole to surround said probe hole for attaching said probe is provided; and said pattern free region is provided outer than it to surround said throughhole land.

31. A multilayer substrate provided with a microstrip line, having four microstrip's pattern layers with a dielectric layer posed therebetween, and provided with a probe hole passing a probe therethrough, wherein:

said microstrip line is provided at one surface layer's pattern and a second layer's pattern cooperating with said one surface layer's pattern to sandwich a dielectric layer; and at least one of said third and fourth layer has a pattern with a ground pattern surrounding said probe and isolated by an inner isolation band corresponding to a pattern free portion in a band surrounding a throughhole land passing said probe and by an outer isolation band corresponding to a pattern free portion in a band located outer than said inner isolation band and surrounding said ground pattern, the isolated ground pattern having conduction with respect to another layer through a throughhole extending through the ground pattern for conduction.

32. The multilayer substrate of claim 31, wherein one of said third and fourth layer has a ground pattern surrounding said probe and having peeled off a region surrounding said throughhole land, the other layer has a ground pattern surrounding said probe and isolated by said inner and outer isolation bands, and the isolated pattern has conduction with respect to a layer other than the peeled layer through said throughhole for conduction.

* * * * *